US007940240B2

(12) United States Patent
Takeuchi et al.

(10) Patent No.: US 7,940,240 B2
(45) Date of Patent: May 10, 2011

(54) SIGNAL PROCESSING FOR REDUCING BLUR OF MOVING IMAGE

(75) Inventors: Kesatoshi Takeuchi, Shiojiri (JP); Takahiro Sagawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 1297 days.

(21) Appl. No.: 11/261,627

(22) Filed: Oct. 31, 2005

(65) Prior Publication Data

US 2006/0092164 A1 May 4, 2006

(30) Foreign Application Priority Data

Nov. 1, 2004 (JP) ..... 2004-317617
Aug. 17, 2005 (JP) ..... 2005-236529
Aug. 17, 2005 (JP) ..... 2005-236532

(51) Int. Cl.
*G09G 3/36* (2006.01)

(52) U.S. Cl. ..... 345/94; 345/87; 345/89; 345/208

(58) Field of Classification Search ..... 345/94, 345/208, 204, 530, 690–692
See application file for complete search history.

(56) References Cited

U.S. PATENT DOCUMENTS 6,903,716 B2 * 6/2005 Kawabe et al. ..... 345/99
6,980,225 B2 12/2005 Funamoto et al.
7,173,594 B2 * 2/2007 Nakamura et al. ..... 345/98
7,173,599 B2 2/2007 Nishimura
7,215,357 B1 * 5/2007 Swift et al. ..... 348/56
2001/0019390 A1 * 9/2001 Itoh et al. ..... 349/130
2002/0063702 A1 * 5/2002 Wada et al. ..... 345/204
2003/0142118 A1 * 7/2003 Funamoto et al. ..... 345/691
2003/0179221 A1 * 9/2003 Nitta et al. ..... 345/690
2004/0001054 A1 * 1/2004 Nitta et al. ..... 345/204
2004/0239698 A1 * 12/2004 Kamada et al. ..... 345/714
2004/0246242 A1 * 12/2004 Sasaki ..... 345/204

FOREIGN PATENT DOCUMENTS

CN 1460242 A 12/2003
EP 1 255 241 A1 11/2002
EP 1255241 A1 * 11/2002
EP 1 494 196 A2 1/2005
JP A-11-143442 5/1999
JP A-2002-132220 5/2002
JP A-2002-0082790 10/2002
JP A-2003-315765 11/2003
JP A-2004-302023 10/2004

* cited by examiner

*Primary Examiner* — Bipin Shalwala
*Assistant Examiner* — Ilana Spar
(74) *Attorney, Agent, or Firm* — Oliff & Berridge, PLC

(57) ABSTRACT

In an image data processing device of the invention, an image memory sequentially stores input image data of multiple frames. A write control module controls a writing operation into the image memory, and a read control module controls a reading operation from the image memory. A driving image data generation module generates the driving image data from read image data sequentially read from the image memory. The driving image data generation module generates the driving image data by replacing at least part of the read image data with regard to selected pixels with mask data. The mask data is set corresponding to a pixel value of the read image data in each of the selected pixels to be replaced with the mask data. This arrangement of the invention effectively reduces blur of a moving image displayed by the image display device, while preventing a significant decrease in luminance level of the displayed image.

32 Claims, 24 Drawing Sheets

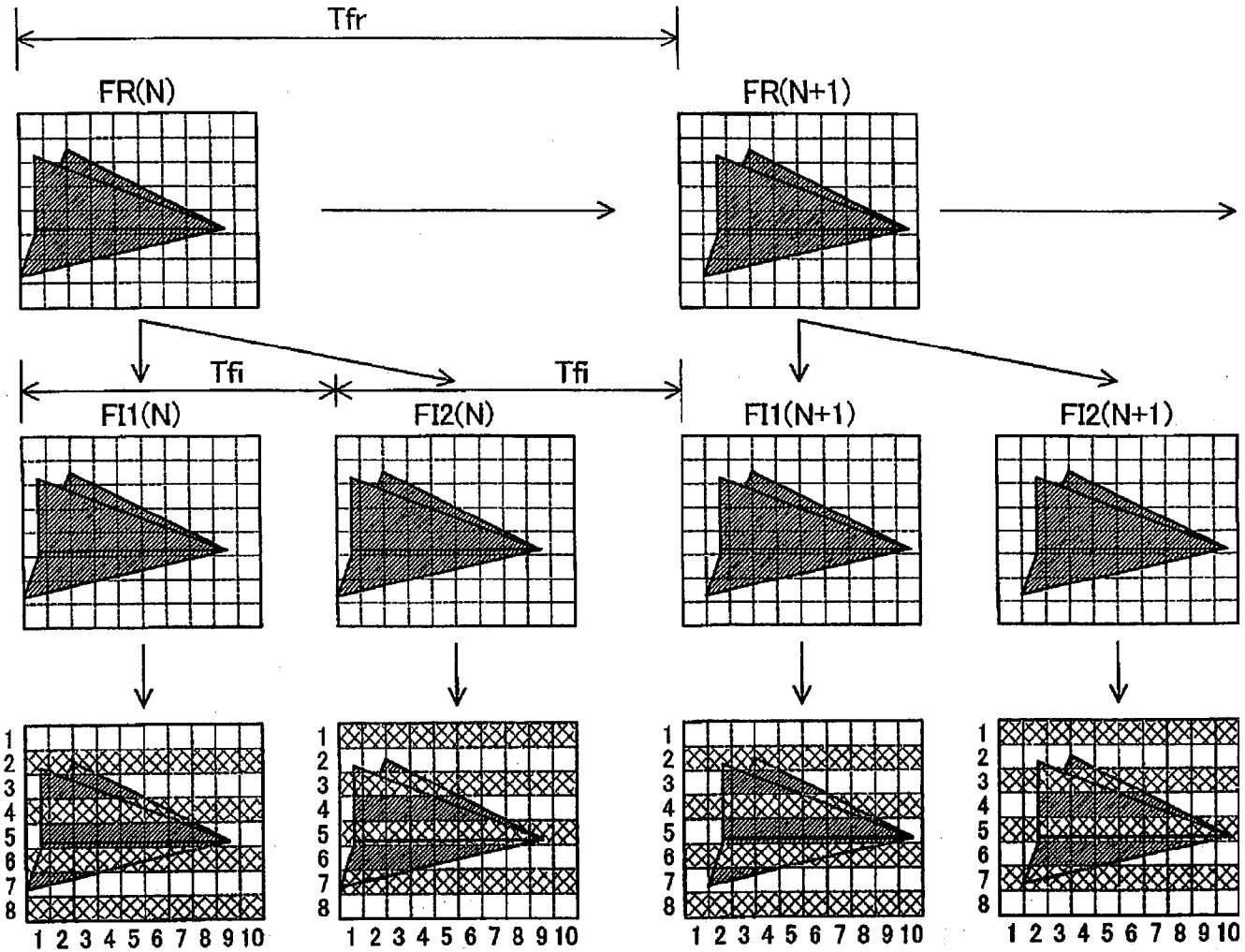
Fig.5(a) Frame Image Data Written into Frame Memory
Fig.5(b) Frame Image Data Read from Frame Memory
Fig.5(c) Driving Image Data

FIELD
FI1
FI2
FI1
FI2
FI1
FI2

VS

HS

DCK
FR(N-1)
FR(N)
FR(N+1)

RVDS
FI1(N-1)
FI2(N-1)
FI1(N)
FI2(N)
FI1(N+1)
FI2(N+1)
FI1

HS
ODD
EVEN
ODD
EVEN

MXS

DVDS
Image Data
Mask Data
Image Data
Mask Data
FI2

HS
ODD
EVEN
ODD
EVEN

MXS

DVDS
Mask Data
Image Data
Mask Data
Image Data

Fig.7(a) Frame Image Data Written into Frame Memory

Fig.7(b) Frame Image Data Read from Frame Memory

Fig.7(c) Driving Image Data

Fig.8(a) Frame Image Data Written into Frame Memory

Fig.8(b) Frame Image Data Read from Frame Memory

Fig.8(c) Driving Image Data

Fig.9(a) Frame Image Data Written into Frame Memory

Fig.9(b) Frame Image Data Read from Frame Memory

Fig.9(c) Driving Image Data

Fig.10(a) FIELD
FI1
FI2
FI1
FI2
FI1
FI2
Fig.10(b) VS
Fig.10(c) HS
Fig.10(d) DCK
FR(N-1)
FR(N)
FR(N+1)
Fig.10(e) RVDS
FI1(N-1)
FI2(N-1)
FI1(N)
FI2(N)
FI1(N+1)
FI2(N+1)
FI1
Fig.10(c1) HS
1.Odd Pixel
2.Even Pixel
3.Odd Pixel
4.Even Pixel
Fig.10(d1) DCK
Fig.10(g1) MXS
Fig.10(g1) DVDS
Image Data
Mask Data
Image Data
Mask Data
FI2
Fig.10(c2) HS
1.Odd Pixel
2.Even Pixel
3.Odd Pixel
4.Even Pixel
Fig.10(d2) DCK
Fig.10(f2) MXS
Fig.10(g2) DVDS
Mask Data
Image Data
Mask Data
Image Data Fig.11(a) Frame Image Data Written into Frame Memory Fig.11(b) Frame Image Data Read from Frame Memory Fig.11(c) Driving Image Data Fig.12(a) Frame Image Data Written into Frame Memory Fig.12(b) Frame Image Data Read from Frame Memory Fig.12(c) Driving Image Data Fig.13(a) Frame Image Data Written into Frame Memory Fig.13(b) Frame Image Data Read from Frame Memory Fig.13(c) Driving Image Data

| | Measurement Conditions | Settings |
|---|---|---|
| Condition 1 | Screen Size | 50 inches (Aspect Ratio 4:3) |
| Condition 2 | Viewing Distance | 3H (H: Vertical Length of Image) |
| Condition 3 | Visual Brightness | Default Setting |
| Condition 4 | Input Signal Resolution | SVGA(800 × 600) |
| Condition 5 | Scroll Amount | 0,3,5,8,10,16[pixel/frame] |

SIGNAL PROCESSING FOR REDUCING BLUR OF MOVING IMAGE

BACKGROUND OF THE INVENTION

1. Field of the Invention

The present invention relates to a signal processing technique for reducing blur of a moving image in a storage display device, such as a liquid crystal display device.

2. Description of the Related Art

Liquid crystal display devices including a liquid crystal panel have been used widely in various fields. The liquid crystal display device is one of storage display devices using storage display elements for respective pixels. The storage display device has a low-pass time-frequency characteristic having the lowered response in a high signal frequency domain. A moving image displayed by the liquid crystal display device may have blur according to the moving speed of an object included in the moving image. A moving image displayed by the storage display device may have blur, due to afterimage on the retinas when the human eyes observe an object moving on the storage display device.

A technique disclosed in Japanese Patent Laid-Open Gazette No. 2002-132220 has been proposed to solve this problem.

The proposed technique reads out image data of each frame in an original image, which is sequentially stored at a frame period into a frame memory, twice at a field period that is half the frame period, and generates two image signals of a first field and a second field. Display of an image expressed by the image signal of the first field and display of an image expressed by the image signal of the second field completes a displayed image corresponding to each frame of the original image. The image signal of the first field is generated by replacing image data on even-numbered horizontal lines among multiple horizontal lines included in the first field with black image data. The image signal of the second field is generated by replacing image data on odd-numbered horizontal lines among the multiple horizontal lines included in the second field with the black image data. In each pixel on a horizontal line in the resulting displayed image, a black image expressed by the black image data is displayed in a previous field, prior to display of an object image expressed by original image data in a current field. Namely each pixel on the horizontal line is reset from display of a previous object image to display of the black image, prior to display of a next object image. This eliminates the effects of the previously displayed image and thus reduces blur of the moving image.

This prior art technique replaces the image data in the pixels on half the horizontal lines included in each field with the black image data. Such replacement undesirably decreases the actual luminance of the displayed image to half the theoretical luminance of each frame image and thereby lowers the contrast of the displayed image.

SUMMARY OF THE INVENTION

The object of the invention is thus to eliminate the drawback of the prior art technique and to provide a technique of reducing blur of a moving image displayed by a storage display device, such as a liquid crystal display device, while preventing a significant decrease in luminance level of the displayed image.

In order to attain at least part of the above and the other related objects, the present invention is directed to a first image data processing device that generates driving image data used to drive an image display device. The first image data processing device includes: an image memory that sequentially stores input image data of multiple frames; a write control module that controls a writing operation into the image memory; a read control module that controls a reading operation from the image memory; and a driving image data generation module that generates the driving image data from read image data sequentially read from the image memory. The driving image data generation module generates the driving image data by replacing at least part of the read image data with regard to selected pixels with mask data. The mask data is set corresponding to a pixel value of the read image data in each of the selected pixels to be replaced with the mask data.

The first image data processing device of the invention generates the driving image data by replacing at least part of the read image data with regard to the selected pixels with the mask data. This arrangement desirably reduces blur of a moving image displayed by the image display device. The mask data to replace the read image data is set corresponding to the pixel value of the read image data in each of the selected pixels to be replaced with the mask data. This arrangement effectively prevents a significant degrease in luminance level of the image displayed by the image display device.

It is preferable that the mask data is generated by a preset operation of the read image data with regard to the selected pixels to be replaced with the mask data, based on a specific parameter set according to an amount of motion of a whole image expressed by the read image data.

The mask data is generated according to the amount of motion of the whole image. This enables effective reduction of blur of the moving image according to the amount of motion.

The specific parameter may be set to vary a ratio of the mask data to the pixel value of the corresponding read image data in a value range of 0 to 1 and to give a smaller ratio against a greater amount of motion and a greater ratio against a smaller amount of motion.

This arrangement facilitates generation of the mask data according to the amount of motion of the whole image.

In the first image data processing device of the invention, it is preferable that the specific parameter is set to give the ratio equal to 1 when the amount of motion is greater than a predetermined reference level.

When the detected amount of motion is greater than the predetermined reference level, the displayed image is treated not as a moving image but as a still image.

It is preferable that the predetermined reference level corresponds to a limit viewing angle rate representing a maximum possible speed of eye tracking.

This arrangement readily specifies the amount of motion that suggests the displayed image not as a moving image but as a still image.

In one preferable embodiment of the first image data processing device, the driving image data generation module generates first driving image data and second driving image data by arranging the read image data and the mask data alternately on every 'm' horizontal lines in an image displayed by the image display device, where 'm' is an integer of not less than 1. The first driving image data and the second driving image data have different sequences of the read image data and the mask data.

In each of the selected pixels, an image expressed by the mask data is displayed momentarily, prior to display of a next image expressed by newly generated read image data. This technique desirably decreases the potential effects of a previously displayed image on the newly displayed image, thus effectively reducing blur of a moving image. This arrangement is especially effective for reduction of blur of a moving image including a motion in the vertical direction. The most significant effect is attained by setting 'm' equal to 1.

It is preferable that the driving image data generation module of this embodiment alternately generates the first driving image data and the second driving image data in a unit of image displayed by the image display device.

The image expressed by the mask data and the image expressed by the read image data are alternately displayed in each pixel of the image display device. This ensures the enhanced effect on reduction of blur of the moving image.

In another preferable embodiment of the first image data processing device, the driving image data generation module generates first driving image data and second driving image data by arranging the read image data and the mask data alternately on every 'n' vertical lines in an image displayed by the image display device, where 'n' is an integer of not less than 1. The first driving image data and the second driving image data have different sequences of the read image data and the mask data.

Generation of the driving image data in this manner also ensures effective reduction of blur of a moving image. This arrangement is especially effective for reduction of blur of a moving image including a motion in the horizontal direction. The most significant effect is attained by setting 'n' equal to 1.

It is preferable that the driving image data generation module of this embodiment alternately generates the first driving image data and the second driving image data in a unit of image displayed by the image display device.

The image expressed by the mask data and the image expressed by the read image data are alternately displayed in each pixel of the image display device. This ensures the enhanced effect on reduction of blur of the moving image.

In still another preferable embodiment of the first image data processing device, the driving image data generation module generates first driving image data and second driving image data by arranging the read image data and the mask data alternately in every block defined by 'p' pixels in a horizontal direction and 'q' pixels in a vertical direction in an image displayed by the image display device, where 'p' and 'q' are integers of not less than 1, in both the horizontal direction and the vertical direction. The first driving image data and the second driving image data have different sequences of the read image data and the mask data.

This arrangement effectively reduces blur of a moving image including motions both in the horizontal direction and in the vertical direction. The most significant effect is attained by setting both 'p' and 'q' equal to 1.

It is preferable that the driving image data generation module of this embodiment alternately generates the first driving image data and the second driving image data in a unit of image displayed by the image display device.

The image expressed by the mask data and the image expressed by the read image data are alternately displayed in each of the selected pixels of the image display device. This ensures the enhanced effect on reduction of blur of the moving image.

In another preferable embodiment of the first image data processing device, the driving image data generation module generates first to (r/s)-th driving image data by replacing the read image data with the mask data at a rate of 's' consecutive pixels to 'r' pixels aligned on each horizontal line in an image displayed by the image display device, where 'r' is an integer of not less than 3 and 's' is an aliquot of 'r'. Positions of the mask data in the 's' pixels among the aligned 'r' pixels being shifted at a cycle of 't' horizontal lines, where 't' is an integer of not less than 1. The first through the (r/s)-th driving image data have different positions of the mask data.

Generation of the driving image data in this manner also effectively reduces blur of a moving image including motions both in the horizontal direction and in the vertical direction.

It is preferable that the driving image data generation module sequentially generates the first through the (r/s)-th driving image data in a unit of image displayed by the image display device.

In each pixel of the image display device, the image expressed by the mask data is repeatedly displayed at a rate of one to (r/s) times for generation of the first through the (r/s)-th driving image data. This arrangement ensures the enhanced effect on reduction blur of a moving image.

In still another preferable embodiment of the first image data processing device, the driving image data generation module generates first driving image data including only the read image data arranged in a whole image displayed by the image display device and second driving image data including only the mask data arranged in a whole image displayed by the image display device.

Generation of the driving image data in this manner also effectively reduces blur of a moving image including motions both in the horizontal direction and in the vertical direction.

In the first image data processing device having any of the above structures, the read image data may be read from the image memory at a plural-fold rate of a frame rate for storage of the input image data of the multiple frames.

This arrangement ensures generation of desirable driving image data without flicker.

In one preferable structure of the arrangement of generating the mask data according to the amount of motion of the whole image, the driving image data generation module generates dimmer data according to the amount of motion, where the dimmer data is used by a dimmer unit to regulate an amount of light emission of the image display device.

This arrangement effectively prevents a significant decrease in luminance level of the displayed image, which occurs in exchange for reduction of blur of the moving image.

Another application of the invention is an image display system including the first image data processing device having any of the above arrangements and the image display device.

In one preferable embodiment of the invention, the image display system further includes a dimmer unit that regulates an amount of light emission of the image display device.

The driving image data generation module generates dimmer data according to the amount of motion, where the dimmer data is used by the dimmer unit to regulate the amount of light emission of the image display device.

Regulation of the amount of light emission of the image display device effectively prevents a significant decrease in luminance level of the displayed image, which occurs in exchange for reduction of blur of the moving image.

The image display device is, for example, a non light-emitting display device.

In this example, the dimmer unit includes: a light source that emits illumination light for illuminating the image display device; and a controller that regulates an amount of light emission of the light source according to the dimmer data.

The light source may include a main light source and an auxiliary light source, and the controller may regulate an amount of light emission of the auxiliary light source.

In order to attain at least part of the above and the other related objects, the present invention is also directed to a second image data processing device that generates driving image data used to drive an image display device. The second image data processing device includes: an image memory that sequentially stores input image data of multiple frames; a motion amount detection module that detects an amount of motion of a whole image expressed by read image data sequentially read from the image memory; and a driving image data generation module that generates the driving image data by replacing at least part of the read image data with regard to selected pixels with mask data generated according to the detected amount of motion.

The mask data is generated by a preset operation of the read image data with regard to the selected pixels to be replaced with the mask data, based on a specific parameter set according to the detected amount of motion. The specific parameter is set to vary a ratio of the mask data to a pixel value of corresponding read image data in a value range of a certain level attaining a specific moving image quality characteristic to 1 and to give a smaller ratio against a greater amount of motion and a greater ratio against a smaller amount of motion.

The second image data processing device of the invention generates the driving image data by replacing at least part of the read image data with regard to the selected pixels with the mask data. This arrangement desirably reduces blur of a moving image displayed by the image display device. The mask data to replace the read image data is generated by the preset operation of the read image data with regard to the selected pixels to be replaced with the mask data, based on the specific parameter set according to the detected amount of motion. The specific parameter is set to vary the ratio of the mask data to the pixel value of the corresponding read image data in the value range of the certain level attaining the specific moving image quality characteristic to 1 and to give the smaller ratio against the greater amount of motion and the greater ratio against the smaller amount of motion. This arrangement enables effective reduction of blur of the moving image, while preventing a significant decrease in luminance level of the image displayed by the image display device according to the detected amount of motion.

The specific parameter may be set to vary the ratio, for example, in a range of 0.5 to 1.

This facilitates the effective reduction of blur of the moving image.

It is preferable that the specific parameter is set to keep the ratio in a specific range attaining a preset contrast characteristic.

This enables effective prevention of a significant decrease in luminance level of the displayed image.

It is preferable that the specific parameter is set to keep the ratio in a value range of 0.8 to 1.

This facilitates the effective prevention of the significant decrease in luminance level of the displayed image.

In the second image data processing device of the invention, it is preferable that the specific parameter is set to give the ratio equal to 1 when the detected amount of motion is greater than a predetermined reference level.

When the detected amount of motion is greater than the predetermined reference level, the displayed image is treated not as a moving image but as a still image in an image transition to a different scene.

It is preferable that the predetermined reference level corresponds to a limit viewing angle rate representing a maximum possible speed of eye tracking.

This arrangement readily specifies the amount of motion that suggests an image transition to a different scene.

Another application of the invention is an image display system including the second image data processing device having any of the above arrangements and the image display device.

The technique of the invention is not restricted to the image data processing device or the image display system including the image data processing device, but may also be actualized by a corresponding image data processing method. There are diversity of other applications of the invention, for example, computer programs that are used to attain the functions of the image data processing device, the image display system, and the image data processing method, recording media in which such computer programs are recorded, and data signals that include such computer programs and are embodied in carrier waves.

In the applications of the invention as the computer programs and the recording media in which the computer programs are recorded, the invention may be given as a whole program to control the operations of the image data processing device or the image display system or as a partial program to exert only the characteristic functions of the invention. Available examples of the recording medium include flexible disks, CD-ROMs, DVD-ROMs, DVD-RAMs, magneto-optical disks, IC cards, ROM cartridges, punched cards, prints with barcodes or other codes printed thereon, internal storage devices (memories like RAMs and ROMs) and external storage devices of the computer, and diversity of other computer readable media.

BRIEF DESCRIPTION OF THE DRAWINGS

FIG. 5 shows generation of driving image data in the first embodiment;

DESCRIPTION OF THE PREFERRED EMBODIMENTS

Some modes of carrying out the invention are described below in the following sequence as preferred embodiments:

A. First Embodiment
- A1. General Configuration of Image Display System
- A2. Structure and Operations of Driving Image Data Generation Module
- A3. Effects of Embodiment
- A4. Modification of Driving Image Data Generation B. Second Embodiment C. Third Embodiment D. Fourth Embodiment
- D1. General Configuration of Image Display System
- D2. Structure and Operations of Driving Image Data Generation Module
- D3. Setting Mask Parameter Characteristic
- D3.1 Picture Quality Characteristic of Moving Image
- D3.2 Contrast Characteristic
- D3.3 Mask Parameter Characteristic
- D4. Effects of Embodiment E. Modification

A. First Embodiment

A1. General Configuration of Image Display System

Figure 1:
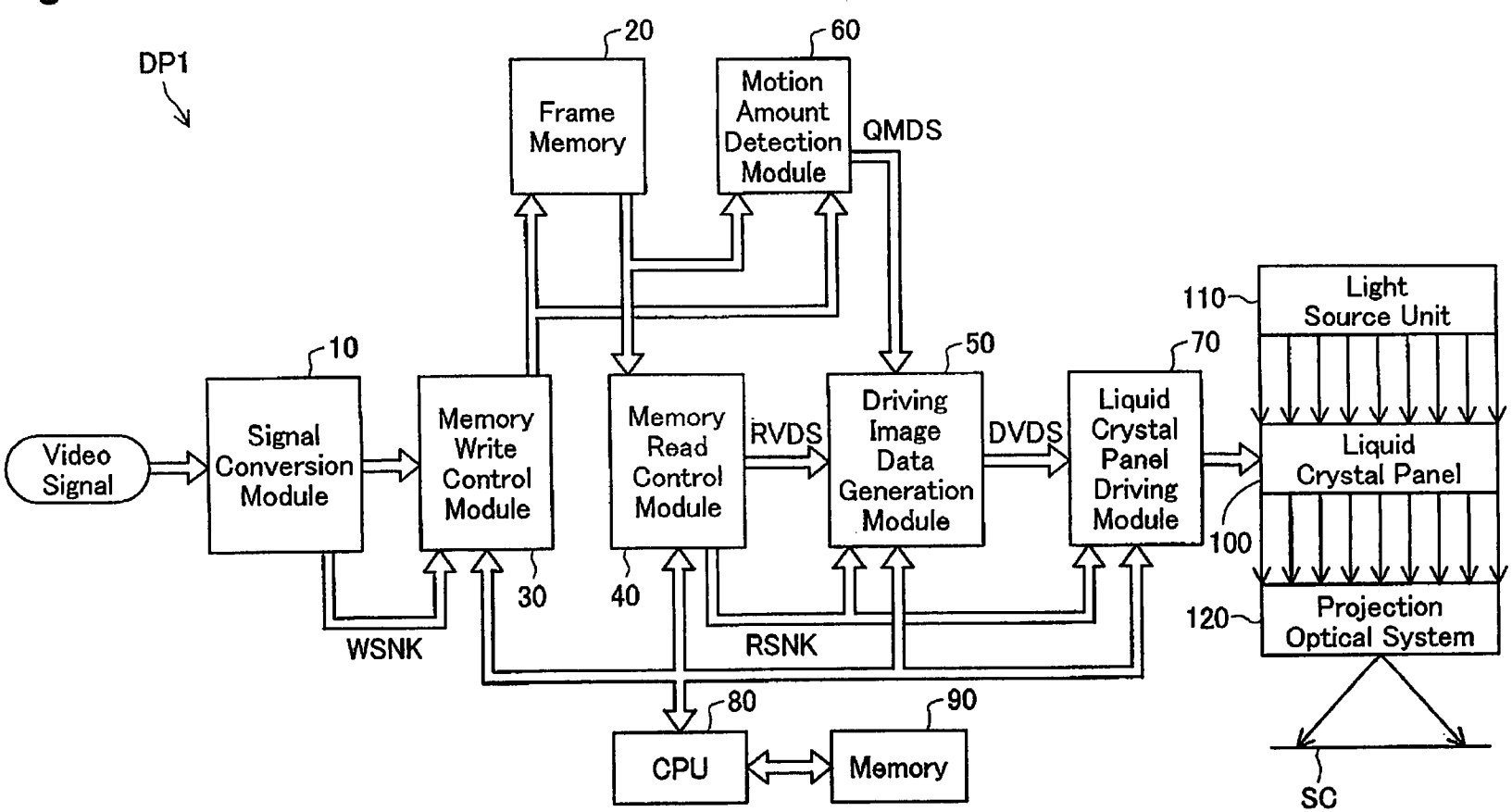
FIG. 1 is a block diagram schematically illustrating the configuration of an image display system including an image data processing device in a first embodiment of the invention.

FIG. 1 is a block diagram schematically illustrating the configuration of an image display system DP1 including an image data processing device in a first embodiment of the invention. The image display system DP1 of the first embodiment is actualized by a computer system including an image data processing device and a storage display device. The image data processing device includes a signal conversion module 10, a frame memory 20, a memory write control module 30, a memory read control module 40, a driving image data generation module 50, a motion amount detection module 60, a liquid crystal panel driving module 70, a CPU 80, and a memory 90, whereas the storage display device is a liquid crystal panel 100. The image display system DP1 further includes external storage devices, interfaces, and diversity of other peripheral devices of the general computer system, although they are omitted from the illustration.

The image display system DP1 is, for example, a projector that converts illumination light emitted from a light source unit 110 into image light representing an image by means of the liquid crystal panel 100 and focuses the image light on a projector screen SC by means of a projection optical system 120. The image is accordingly projected on the projector screen SC. The liquid crystal panel driving module 70 may not be included in the image data processing device but may be combined with the liquid crystal panel 100 to be incorporated in the storage display device.

The CPU 80 reads a control program and preset processing conditions stored in the memory 90 and executes the control program with the preset processing conditions to control the operations of the respective modules.

The signal conversion module 10 is a processing circuit to convert externally input video signals into signals processable by the memory write control module 30. For example, an analog video signal representing an image is converted into a digital video signal, in synchronism with a synchronizing signal included in the analog video signal.

The memory write control module 30 sequentially writes image data of individual frames, which are included in the digital video signal output from the signal conversion module 10, into the frame memory 20, synchronously with a write synchronizing signal WSNK corresponding to the digital video signal. The write synchronizing signal WSNK includes a write vertical synchronizing signal, a write horizontal synchronizing signal, and a write clock signal.

The memory read control module 40 generates a read synchronizing signal RSNK on a read control condition read from the memory 90 by the CPU 80, and reads out the image data stored in the frame memory 20, synchronously with the generated read synchronizing signal RSNK. The memory read control module 40 outputs a read image data signal RVDS representing the read-out image data and the read synchronizing signal RSNK to the driving image data generation module 50. The read synchronizing signal RSNK includes a read vertical synchronizing signal, a read horizontal synchronizing signal, and a read clock signal. The period of the read vertical synchronizing signal is half the period of the write vertical synchronizing signal of the video signal written into the frame memory 20 (hereafter referred to as frame period). Namely the speed of reading the image data from the frame memory 20 is double the speed of writing the image data into the frame memory 20. The memory read control module 40 reads image data twice from the storage of the frame memory 20 during one frame period and outputs the read-out image data as the read image data signal RVDS to the driving image data generation module 50.

The driving image data generation module 50 generates a driving image data signal DVDS to drive the liquid crystal panel 100 via the liquid crystal panel driving module 70, in response to the read image data signal RVDS and the read synchronizing signal RSNK output from the memory read control module 40 and a motion amount data signal QMDS output from the motion amount detection module 60. The driving image data signal DVDS thus generated is supplied to the liquid crystal panel driving module 70.

The motion amount detection module 60 compares the image data of each frame sequentially written into the frame memory 20 (hereafter referred to as 'frame image data') with read image data of the corresponding frame read from the frame memory 20 (that is, read image data of the corresponding frame including a first field and a second field as discussed later) to detect an amount of motion of the image. The detected amount of motion is output as the motion amount data signal QMDS to the driving image data generation module 50. The procedure of detecting the amount of motion will be described later in detail.

The liquid crystal panel driving module 70 converts the driving image data signal DVDS supplied from the driving image data generation module 50 into a signal in a suppliable form to the liquid crystal panel 100 and supplies the converted driving image data signal to the liquid crystal panel 100.

The liquid crystal panel 100 emits the image light representing the image corresponding to the supplied driving image data signal. The image represented by the image light emitted from the liquid crystal panel 100 is accordingly projected and displayed on the projector screen SC.

A2. Structure and Operations of Driving Image Data Generation Module

Figure 2:
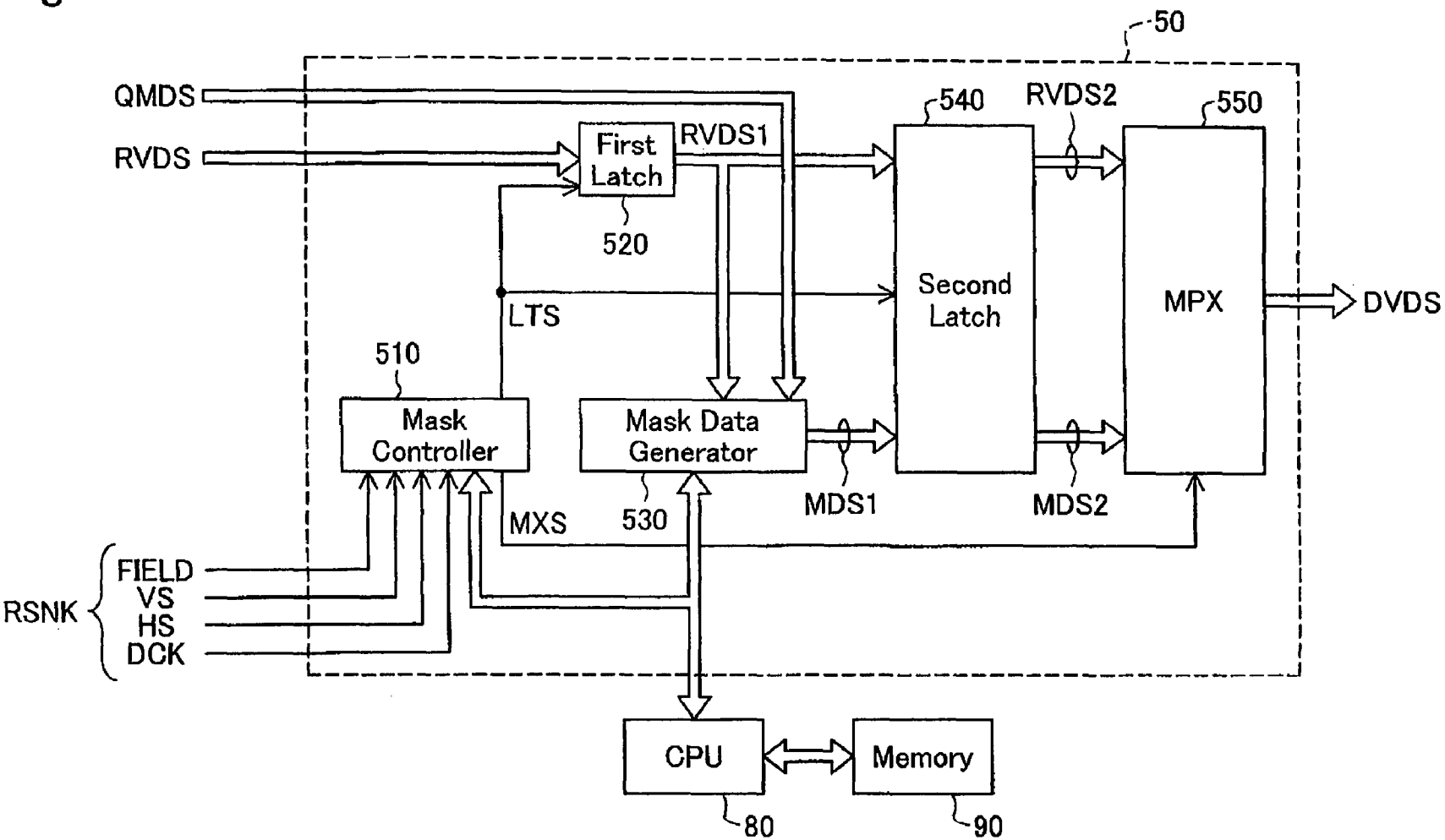
FIG. 2 is a block diagram schematically illustrating the structure of a driving image data generation module included in the image data processing device of the image display system shown in FIG. 1.

FIG. 2 is a block diagram schematically illustrating the structure of the driving image data generation module 50. The driving image data generation module 50 includes a mask controller 510, a first latch 520, a mask data generator 530, a second latch 540, and a multiplexer (MPX) 550.

The mask controller 510 receives the read synchronizing signal RSNK output from the memory read control module 40, generates a latch signal LTS and a selection control signal MXS in response to a read vertical synchronizing signal VS, a read horizontal synchronizing signal HS, a read clock DCK, and a field selection signal FIELD included in the received read synchronizing signal RSNK, and outputs the generated latch signal LTS and the generated selection control signal MXS to control generation of the driving image data signal DVDS. The latch signal LTS controls the operations of the first latch 520 and the second latch 540, while the selection control signal MXS controls the operations of the multiplexer 550. The field selection signal FIELD identifies whether the read image data signal RVDS read from the frame memory 20 at the double speed is either a read image data signal of a first field or a read image data signal of a second field.

The first latch 520 sequentially latches the read image data signal RVDS output from the memory read control module 40 in response to the latch signal LTS output from the mask controller 510, and supplies the latched read image data as a read image data signal RVDS1 to the mask data generator 530 and to the second latch 540.

The mask data generator 530 receives the motion amount data signal QMDS output from the motion amount detection module 60 and the read image data signal RVDS1 supplied from the first latch 520, generates mask data representing pixel values determined corresponding to pixel values of the received read image data with regard to respective pixels, and outputs the generated mask data as a mask data signal MDS1 to the second latch 540.

Figure 3:
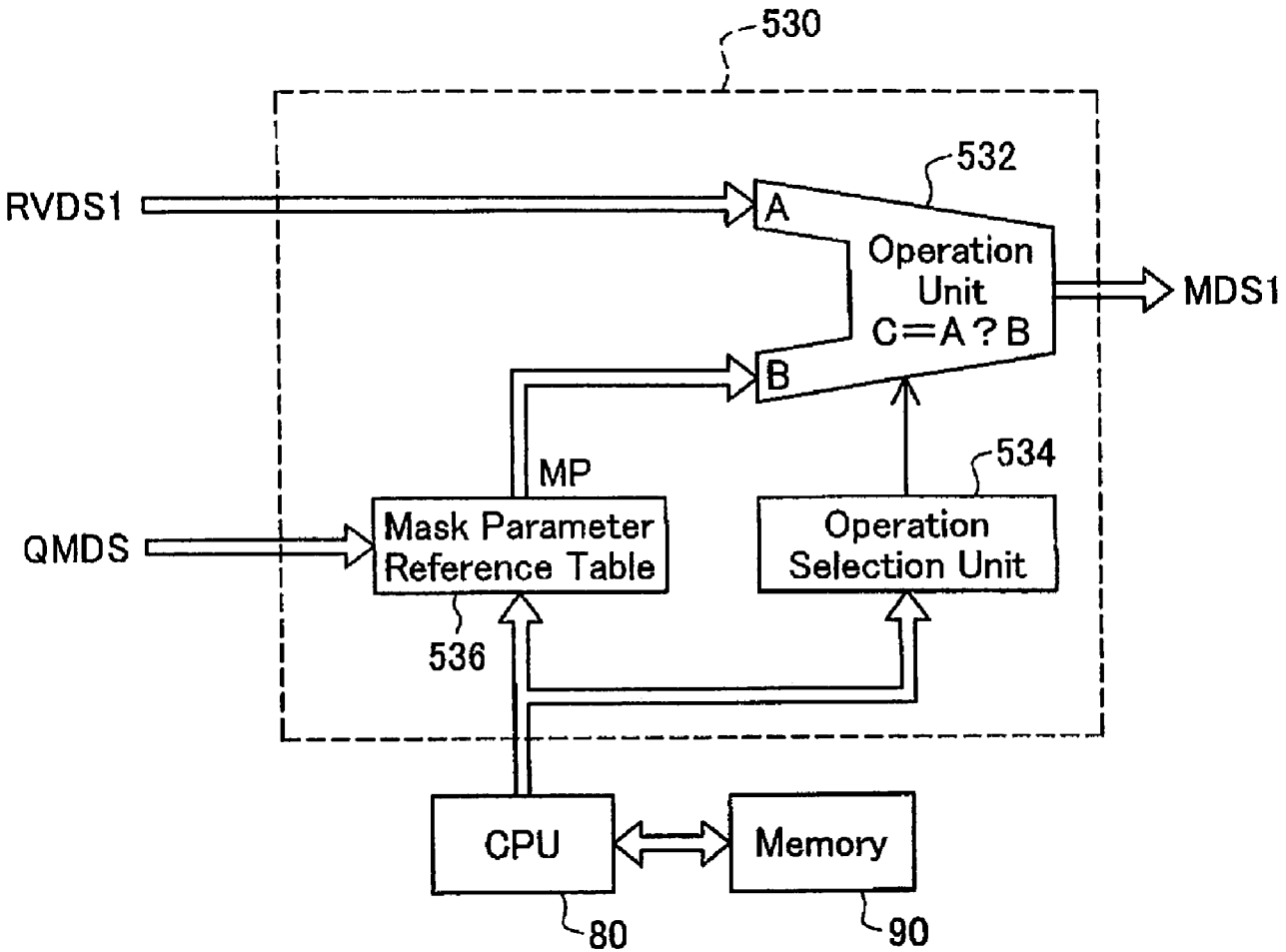
FIG. 3 is a block diagram schematically illustrating the structure of a mask data generator included in the driving image data generation module of FIG. 2.

FIG. 3 is a block diagram schematically illustrating the structure of the mask data generator 530. The mask data generator 530 includes an operation unit 532, an operation selection unit 534, and a mask parameter reference table 536.

The operation selection unit 534 receives a preset mask data generation condition stored in the memory 90 in response to an instruction from the CPU 80 and selectively sets an operation corresponding to the received mask data generation condition in the operation unit 532. The operation performed by the operation unit 532 may be one of various operations, for example, multiplication or bit-shift operation. In this embodiment, multiplication (C=A*B) is selectively set to the operation performed by the operation unit 532.

The mask parameter reference table 536 stores table data, which is read and supplied from the memory 90 by the CPU 90 and shows a variation in value of a mask parameter MP in relation to the normalized amount of motion of the image. The mask parameter reference table 536 refers to this stored table data, specifies the value of the mask parameter MP corresponding to an amount of motion Vm expressed by the motion amount data signal QMDS output from the motion amount detection module 60, and outputs data representing the specified value of the mask parameter MP to the operation unit 532. The table data may be replaced by function operation of a polynomial approximation.

Figure 4:
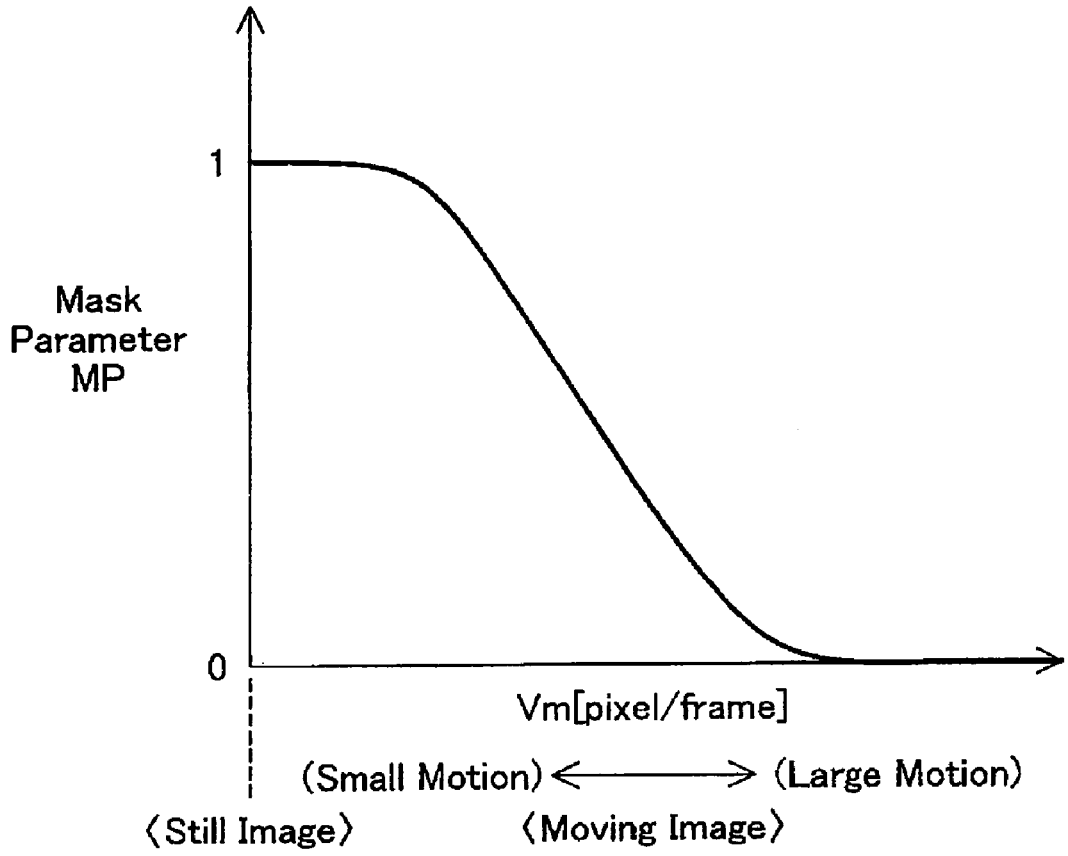
FIG. 4 shows table data stored in a mask parameter reference table included in the mask data generator of FIG. 3.

FIG. 4 shows the table data stored in the mask parameter reference table 536. The table data of FIG. 4 is given as a characteristic curve of the mask parameter MP (in a value range of 0 to 1) against the amount of motion Vm. The amount of motion Vm represents a moving speed expressed by the number of moving pixels per frame [pixels/frame]. The greater amount of motion Vm reflects the quicker motion of the image and may lead to the greater degree of image blur. The mask parameter MP is thus set to vary in the value range of 0 to 1 and give the smaller value corresponding to the greater amount of motion Vm and the greater value corresponding to the smaller amount of motion Vm.

Referring back to FIG. 3, the operation unit 532 sets the read image data included in the input read image data signal RVDS1 to an operation parameter A and the specified value of the mask parameter MP output from the mask parameter reference table 536 to an operation parameter B, and performs the selected operation (A?B: where ? denotes an operator representing the selected operation) by the operation selection unit 534. The operation unit 532 outputs the result of the operation C (=A?B) as the mask data signal MDS1. The mask data with regard to each pixel of the image expressed by the input read image data RVDS1 is accordingly generated corresponding to the amount of motion of the image and the read image data of the pixel.

In this embodiment, multiplication (C=A*B) is selectively set as the operation performed by the operation unit 532 as mentioned above. The operation unit 532 sets the operation parameter B to a value '0.3' of the mask parameter MP specified by the mask parameter reference table 536. When values '00h', '32h', and 'FFh' of the read image data included in the input read image data signal RVDS1 are set to the operation parameter A, the operation unit 532 outputs mask data having values '00h', '0Fh', and '4Ch' as the mask data signal MDS1. Namely the specified value of the mask parameter MP represents a ratio of the mask data to the pixel value of the read image data (attenuation ratio).

The motion amount detection module 60 may adopt any of known motion vector computation techniques to readily compute the amount of motion Vm. One applicable procedure divides an image of one frame into multiple blocks of 'm' pixels by 'n' pixels, where 'm' and 'n' are both integers of not less than 2. The procedure specifies a motion vector of each block representing a motion between two adjoining frames and sets the magnitude of the motion vector to the amount of motion in the block. The amounts of motion in all the blocks are summed up to give the amount of motion Vm of the image between the two adjoining frames. The motion vector of each block is readily specified by determining a moving distance (a variation of the coordinate values) of the center of gravity in image data (luminance data) of the block.

Referring back to FIG. 2, the second latch 540 sequentially latches the read image data signal RVDS1 supplied from the first latch 520 and the mask data signal MDS1 output from the mask data generator 530 in response to the latch signal LTS, and supplies the latched read image data as a read image data signal RVDS2 and the latched mask data as a mask data signal MDS2 to the multiplexer 550.

The multiplexer 550 selects either of the read image data signal RVDS2 and the mask data signal MDS2 in response to the selection control signal MXS output from the mask controller 510 and outputs the selected signal as the driving image data signal DVDS to the liquid crystal panel driving module 70.

The selection control signal MXS is generated in response to the field signal FIELD, the read vertical synchronizing signal VS, the read horizontal synchronizing signal HS, and the read clock DCK to cause the mask data inserted in the read image data to have a predetermined mask pattern.

FIG. 5 shows generation of the driving image data. The memory write control module 30 (see FIG. 1) stores frame image data of each frame at a preset frame period Tfr into the frame memory 20 as shown in FIG. 5(*a*). In the illustrated example of FIG. 5(*a*), frame image data FR(N) of an N-th frame and frame image data FR(N+1) of an (N+1)-th frame are sequentially stored into the frame memory 20, where N is an integer of not less than 1.

The memory read control module 40 (see FIG. 1) reads frame image data twice from the storage of the frame memory 20 at a field period Tfi, which is half the frame period Tfr, and sequentially outputs the two frame image data as read image data FI1 of a first field and read image data FI2 of a second field, as shown in FIG. 5(*b*). In the illustrated example of FIG. 5(*b*), read image data FI1(N) of a first field and read image data FI2(N) of a second field in the N-th frame and read image data FI1(N+1) of a first field and read image data FI2(N+1) of a second field in the (N+1)-th frame are sequentially read and output from the frame memory 20.

The driving image data generation module 50 (see FIG. 1) generates first driving image data by replacement of the read image data FI1 of the first field corresponding to even-numbered horizontal lines (2,4,6,8 . . . ) with mask data (cross-hatched areas), as shown in FIG. 5(*c*). The driving image data generation module 50 also generates second driving image data by replacement of the read image data FI2 of the second field corresponding to odd-numbered horizontal lines (1,3,5, 7, . . . ) with mask data One possible modification may alternatively replace the read image data FI1 of the first field corresponding to the odd-numbered horizontal lines with mask data, while replacing the read image data FI2 of the second field corresponding to the even-numbered horizontal lines with mask data.

For the simplicity of explanation, in the illustrated image of FIG. 5 expressed by the driving image data, each frame image consists of only 8 horizontal lines and 10 vertical lines and is thus shown as a discrete image. In an actual image, however, each frame image consists of several hundred horizontal lines and vertical lines. Such discreteness is hardly recognizable by the human vision.

Figures 6, 6A, 6B, 6C, 6D, 6E:
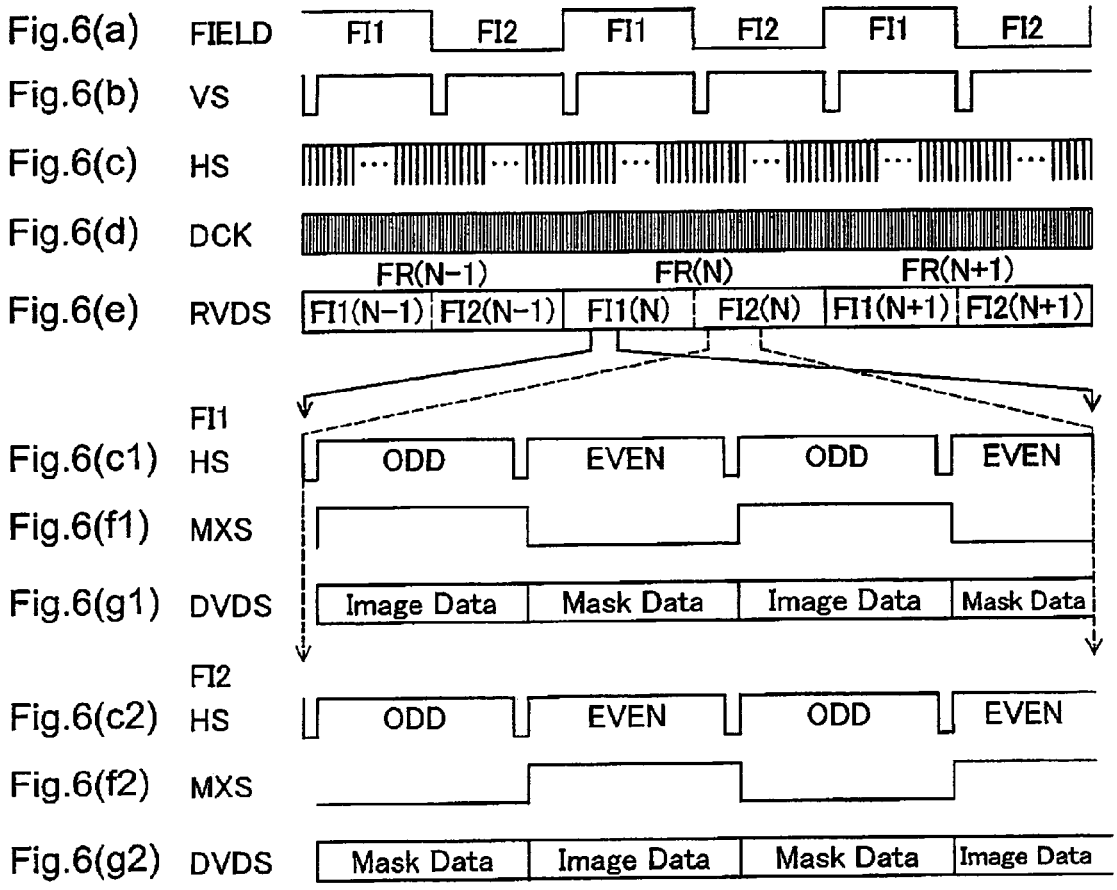
FIG. 6 is a timing chart showing generation of a driving image data signal.

FIG. 6 is a timing chart showing generation of the driving image data signal. The driving image data generation module 50 receives the read image data signal RVDS (FIG. 6(*e*)), synchronously with the field signal FIELD (FIG. 6(*a*)), the read vertical synchronizing signal VS (FIG. 6(*b*)), the read horizontal synchronizing signal HS (FIG. 6(*c*)), and the read clock DCK (FIG. 6(*d*)). In a high (H)-level period of the field signal FIELD, the read image data signal RVDS includes the read image data FI1 of the first field. In a low (L)-level period of the field signal FIELD, the read image data signal RVDS includes the read image data FI2 of the second field. Namely the read image data FI1 of the first field and the read image data FI2 of the second field are alternately input as the read image data signal RVDS of respective frames into the driving image data generation module 50, synchronously with the read vertical synchronizing signal VS. In the illustrated example of FIG. 6, read image data FI1(N−1), FI2(N−1), FI1(N), FI2(N), FI1(N+1), and FI2(N+1) of the first field and the second field in (N−1)-th frame, N-th frame, and (N+1)-th frame (where N is an integer of not less than 2) are input as the read image data signal RVDS of the respective frames into the driving image data generation module 50.

In the input period of the read image data signal RVDS of the first field (hereafter referred to as 'first field period'), the selection control signal MXS (FIG. 6(*f*1)) is kept at a level H during each horizontal scanning period corresponding to each odd-numbered horizontal line (odd H line), that is, each odd-numbered period of the read horizontal synchronizing signal HS (FIG. 6(*c*1)). The selection control signal MXS is kept at a level L, on the other hand, during each horizontal scanning period corresponding to each even-numbered horizontal line (even H line), that is, each even-numbered period of the read horizontal synchronizing signal HS. The multiplexer 550 (see FIG. 2) accordingly outputs the read image data during the horizontal scanning periods corresponding to the odd-numbered horizontal lines and the mask data during the horizontal scanning periods corresponding to the even-numbered horizontal lines, as the driving image data signal DVDS (FIG. 6(*g*1)).

In the input period of the read image data signal RVDS of the second field (hereafter referred to as 'second field period'), the selection control signal MXS (FIG. 6(*f*2)) is kept at the level L during each horizontal scanning period corresponding to each odd-numbered horizontal line, that is, each odd-numbered period of the read horizontal synchronizing signal HS (FIG. 6(*c*2)). The selection control signal MXS is kept at the level H, on the other hand, during each horizontal scanning period corresponding to each even-numbered horizontal line, that is, each even-numbered period of the read horizontal synchronizing signal HS. The multiplexer 550 (see FIG. 2) accordingly outputs the mask data during the horizontal scanning periods corresponding to the odd-numbered horizontal lines and the read image data during the horizontal scanning periods corresponding to the even-numbered horizontal lines, as the driving image data signal DVDS (FIG. 6(*g*2)).

As described above, the driving image data generation module 50 of the embodiment generates the first driving image data signal by replacement of the read image data with the mask data during the horizontal scanning periods corresponding to the even-numbered horizontal lines of the read image data signal in the first field period. The driving image data generation module 50 also generates the second driving image data signal by replacement of the read image data with the mask data during the horizontal scanning periods corresponding to the odd-numbered horizontal lines in the second field period.

A3. Effects of Embodiment

The system of the first embodiment reads out the image data of one frame as the image data of the first field and the image data of the second field. The system then generates the first driving image data by replacement of the read image data of the first field corresponding to the even-numbered horizontal lines with the mask data, while generating the second driving image data by replacement of the read image data of the second field corresponding to the odd-numbered horizontal lines with the mask data. The mask data and the image data are thus alternately input at the field period Tfi into each pixel on each horizontal line of the liquid crystal panel. Namely the image expressed by the mask data is displayed momentarily in each pixel, prior to display of a next image expressed by newly generated read image data. This technique desirably decreases the potential effects of a previously displayed image on the newly displayed image, thus effectively reducing blur of a moving image to the equivalent level to that attained by the prior art technique.

The prior art technique proposed for reduction of blur of a moving image replaces the image data of the first field corresponding to the even-numbered horizontal lines with black image data, while replacing the image data of the second field corresponding to the odd-numbered horizontal lines with black image data. This reduces the actual luminance of a displayed image to almost half the theoretical luminance of each frame image. The technique of the first embodiment, on the other hand, generates the mask data by the preset operation of the original image data according to the amount of motion (degree of motion) in the image expressed by the original image data. The technique of the embodiment replaces the image data of the first field corresponding to the even-numbered horizontal lines with the mask data, while replacing the image data of the second field corresponding to the odd-numbered horizontal lines with the mask data. The mask data replacing the image data of the first field and the image data of the second field is not the simple black image data but is the image data obtained by the preset operation of the original image data according to the amount of motion in the image. This arrangement desirably prevents reduction of the actual luminance of the displayed image.

A4. Modification of Driving Image Data Generation

A4.1. Modified Example 1

Figure 7:
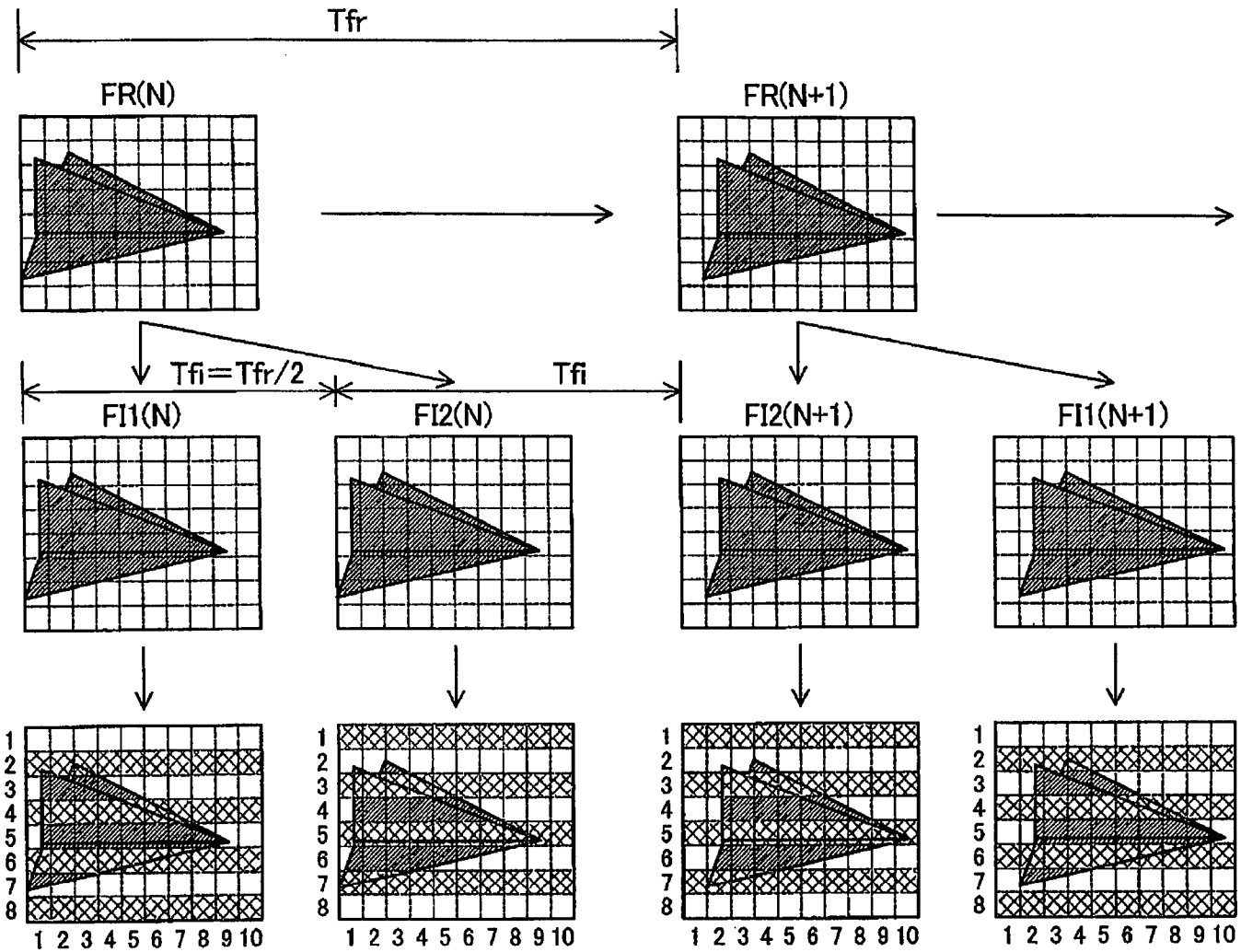
FIG. 7 shows generation of driving image data in a first modified example.

FIG. 7 shows generation of driving image data in a first modified example. Like the first embodiment shown in FIG. 5, each frame image data is stored at the frame period Tfr into the frame memory 20. In the illustrated example of FIG. 7(*a*), frame image data FR(N) of an N-th frame and frame image data FR(N+1) of an (N+1)-th frame are sequentially stored into the frame memory 20. Read image data FI1(N) of a first field and read image data FI2(N) of a second field in the N-th frame and read image data FI1(N+1) of the first field and read image data FI2(N+1) of the second field in the (N+1)-th frame are sequentially read and output from the frame memory 20 as shown in FIG. 7(*b*).

The typical driving process of the liquid crystal panel inverts the polarity of the signal given to each pixel on the liquid crystal panel at the period of the vertical synchronizing signal (the frame period or the field period), with a view to preventing deterioration of liquid crystal. The system of the first embodiment shown in FIG. 5 replaces the read image data of the first field corresponding to the even-numbered horizontal lines with the mask data, while replacing the read image data of the second field corresponding to the odd-numbered horizontal lines with the mask data. Namely the mask data signal given to each pixel on the liquid crystal panel has the fixed polarity to cause direct current drive, which is undesirable for liquid crystal.

The system of the first modified example sequentially generates first driving image data corresponding to the read image data FI1(N) of the first field and second driving image data corresponding to the read image data FI2(N) of the second field as driving image data of the N-th frame. The system of this modified example then sequentially generates second driving image data corresponding to the read image data FI2(N+1) of the second field and first driving image data corresponding to the read image data FI1(N+1) of the first field as driving image data of the (N+1)-th frame as shown in FIG. 7(*c*). The polarity of the signal given to each pixel on the liquid crystal panel is thus alternately inverted, in response to the mask data given to the corresponding pixel on the horizontal lines. This arrangement attains alternate current drive, which is desirable for liquid crystal.

A4.2. Modified Example 2

Figure 8:
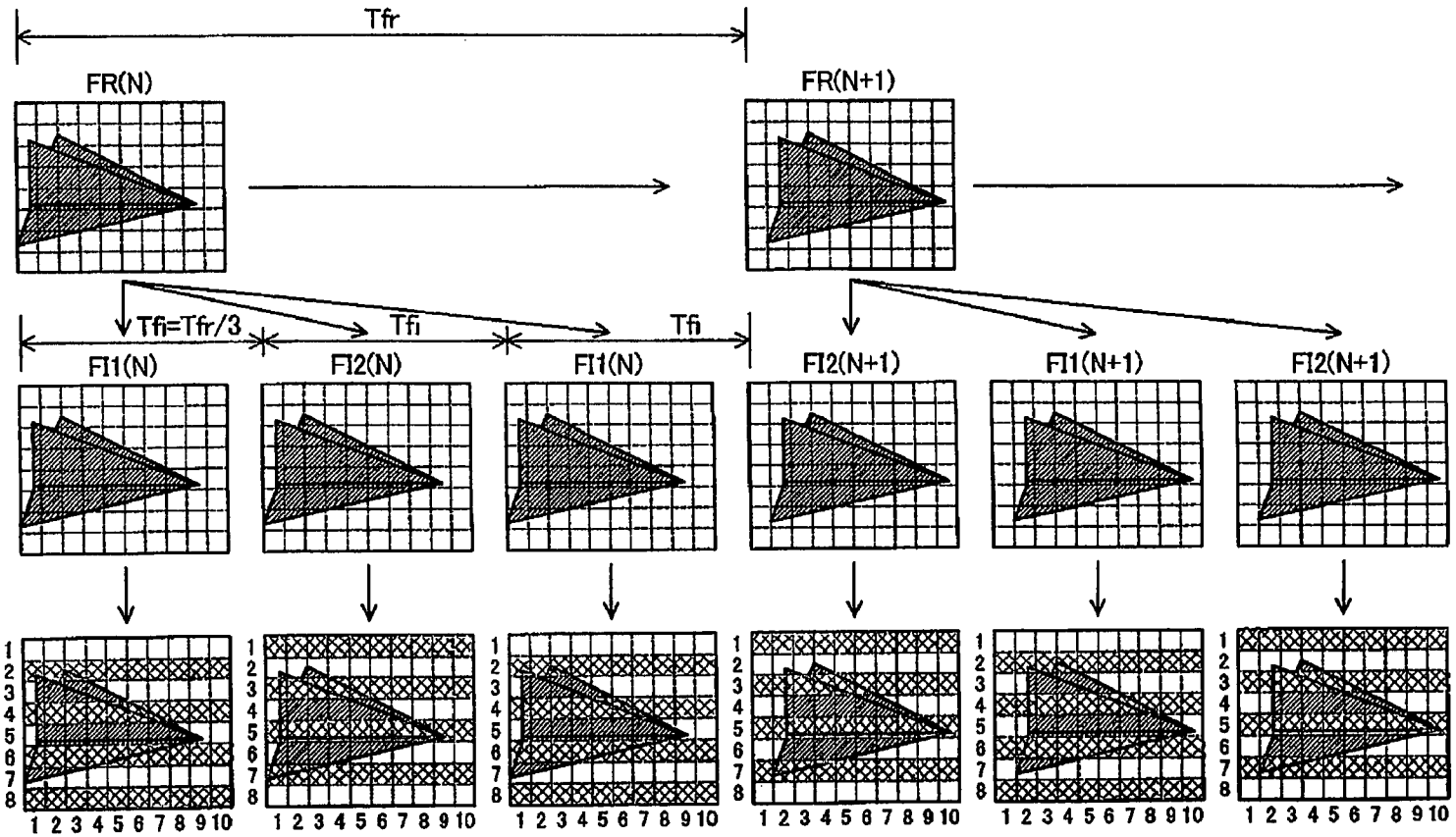
FIG. 8 shows generation of driving image data in a second modified example.

FIG. 8 shows generation of driving image data in a second modified example.

The system of the first embodiment reads the image data of one frame twice from the storage of the frame memory 20 at the field period Tfi, which is half the frame period Tfr, as shown in FIG. 5. The two field image data are thus equivalent to one frame image data. This is, however, not restrictive. A possible modified procedure may read the image data of one frame three or more times from the storage of the frame memory 20 during the frame period Tfr to generate driving image data, as shown in FIG. 8.

The system of the second modified example sequentially reads and outputs image data of one frame from the storage of the frame memory 20 three times at the field period Tfi, which is one third the frame period Tfr. As shown in FIG. 8(*b*), among three image data read from the frame memory 20 corresponding to frame image data FR(N) of an N-th frame, the first and the third image data are read image data FI1(N) of a first field, whereas the second image data is read image data FI2(N) of a second field. As shown in FIG. 8(*c*), the system of this modified example generates first driving image data by replacement of the read image data FI1(N) of the first field corresponding to the even-numbered horizontal lines with mask data (crosshatched areas), while generating second driving image data by replacement of the read image data FI2(N) of the second field corresponding to the odd-numbered horizontal lines with mask data.

As shown in FIG. 8(*b*), among three image data read from the frame memory 20 corresponding to frame image data FR(N+1) of an (N+1)-th frame, the first and the third image data are read image data FI2(N+1) of the second field, whereas the second image data is read image data FI1(N+1) of the first field. As shown in FIG. 8(*c*), the system of this modified example generates first driving image data by replacement of the read image data FI1(N+1) of the first field corresponding to the even-numbered horizontal lines with mask data (crosshatched areas), while generating second driving image data by replacement of the read image data FI2(N+1) of the second field corresponding to the odd-numbered horizontal lines with mask data.

The first read image data in the frame period Tfr of the N-th frame is the read image data FI1(N) of the first field, and the second read image data is the read image data FI2(N) of the second field. The first and the second driving image data generated corresponding to these two read image data express the frame image FR(N) of the N-th frame.

The second read image data in the frame period Tfr of the (N+1)-th frame is the read image data FI1(N+1) of the first field, and the third read image data is the read image data FI2(N+1) of the second field. The first and the second driving image data generated corresponding to these two read image data express the frame image FR(N+1) of the (N+1)-th frame.

The third read image data in the frame period Tfr of the N-th frame is the read image data FI1(N) of the first field, while the first read image data in the frame period Tfr of the (N+1)-th frame is the read image data FI2(N+1) of the second field. The first and the second driving image data generated corresponding to these two read image data express one frame image, which is effectively interpolated between the N-th frame and the (N+1)-th frame by taking advantage of the characteristics of the human vision. The interpolated frame image desirably prevents potential picture quality deteriorations due to a discontinuous image change, for example, flicker caused by an abrupt image change between the N-th frame and the (N+1)-th frame.

A4.3. Modified Example 3

Figure 9:
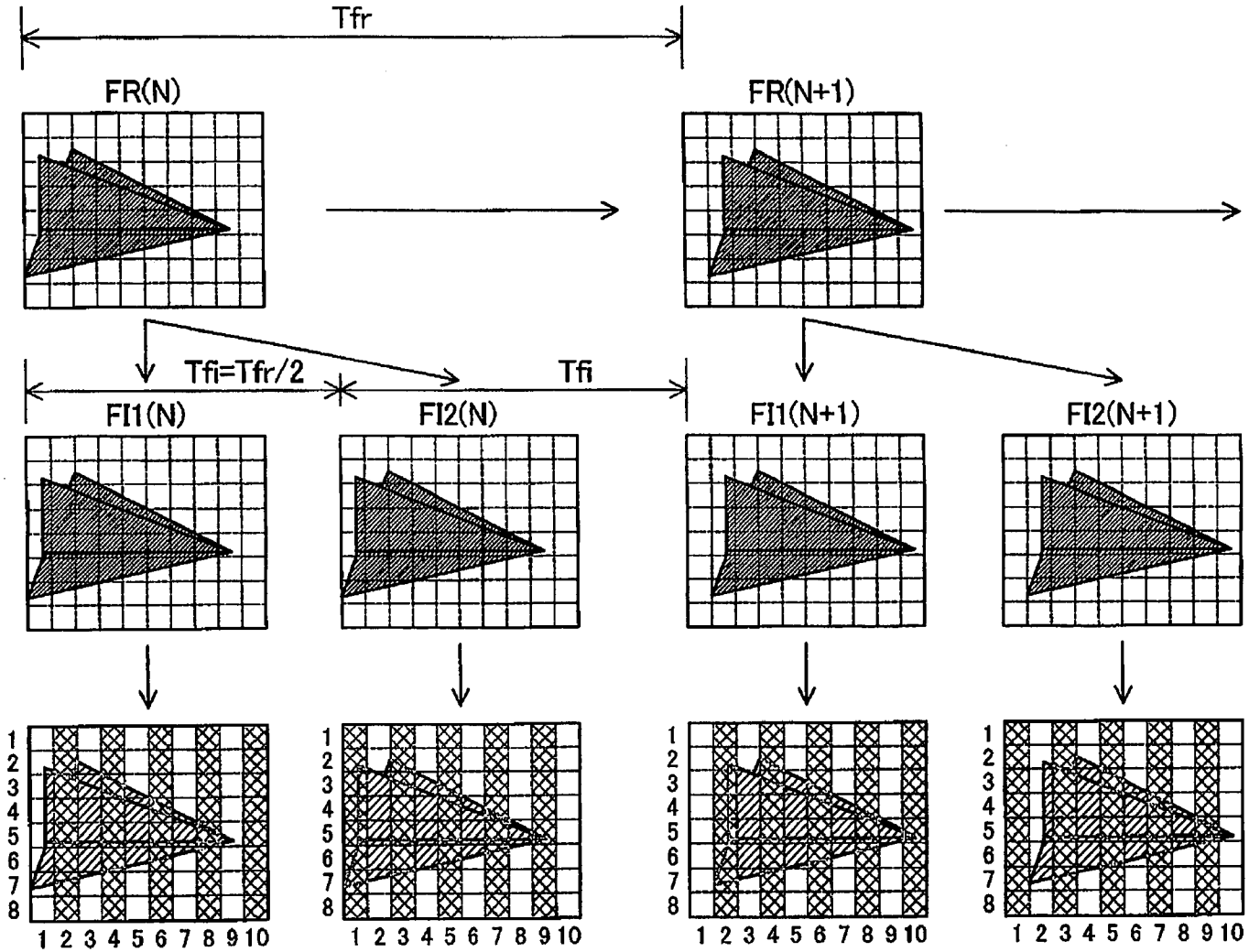
FIG. 9 shows generation of driving image data in a third modified example.

FIG. 9 shows generation of driving image data in a third modified example. Like the first embodiment shown in FIG. 5, each frame image data is stored at the frame period Tfr into the frame memory 20. In the illustrated example of FIG. 9(*a*), frame image data FR(N) of an N-th frame is stored into the frame memory 20.

In the third modified example, the memory read control module reads image data of one frame twice from the storage of the frame memory 20 at the field period Tfi, which is half the frame period Tfr, and sequentially outputs the two read image data as read image data FI1 of a first field and read image data FI2 of a second field, as shown in FIG. 9(*b*).

The driving image data generation module of the third modified example generates first driving image data by replacement of the read image data FI1 of the first field corresponding to even-numbered vertical lines (2,4,6,8, . . . ) with mask data (crosshatched areas), while generating second driving image data by replacement of the read image data FI2 of the second field corresponding to odd-numbered vertical lines (1,3,5,7, . . . ) with mask data, as shown in FIG. 9(*c*).

One possible modification may alternatively replace the read image data FI1 of the first field corresponding to odd-numbered vertical lines with mask data, while replacing the read image data FI2 of the second field corresponding to even-numbered vertical lines with mask data.

For the simplicity of explanation, in the illustrated image of FIG. 9 expressed by the driving image data, each frame image consists of only 8 horizontal lines and 10 vertical lines and is thus shown as a discrete image. In an actual image, however, each frame image consists of several hundred horizontal lines and vertical lines. Such discreteness is hardly recognizable by the human vision.

Figure 10:
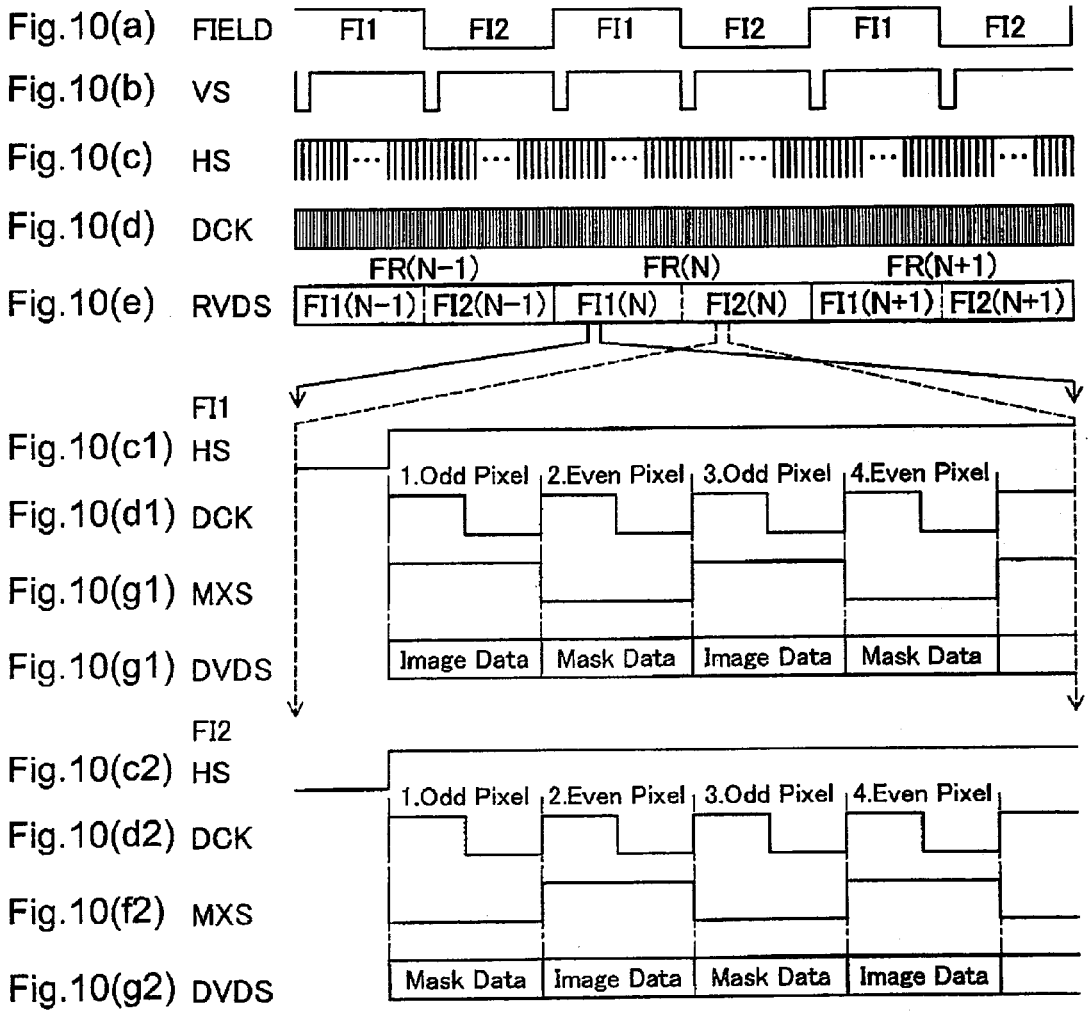
FIG. 10 is a timing chart showing generation of the driving image data signal in the third modified example.

FIG. 10 is a timing chart showing generation of the driving image data signal in the third modified example. The driving image data generation module of this modified example receives the read image data signal RVDS (FIG. 10(*e*)), synchronously with the field signal FIELD (FIG. 10(*a*)), the read vertical synchronizing signal VS (FIG. 10(*b*)), the read horizontal synchronizing signal HS (FIG. 10(*c*)), and the read clock DCK (FIG. 10(*d*)). In the H-level period of the field signal FIELD, the read image data signal RVDS includes the read image data FI1 of the first field. In the L-level period of the field signal FIELD, the read image data signal RVDS includes the read image data FI2 of the second field. Namely the read image data FI1 of the first field and the read image data FI2 of the second field are alternately input as the read image data signal RVDS of the respective frames into the driving image data generation module, synchronously with the read vertical synchronizing signal VS. In the illustrated example of FIG. 10, read image data FI1(N−1), FI2(N−1), FI1(N), FI2(N), FI1(N+1), and FI2(N+1) of the first field and the second field in (N−1)-th frame, N-th frame, and (N+1)-th frame (where N is an integer of not less than 2) are input as the read image data signal RVDS of the respective frames into the driving image data generation module.

In the first field period, the selection control signal MXS (FIG. 10(*f*1)) alternately varies between the level H and the level L at the clock period of the read clock DCK (FIG. 10(*d*1)) during each horizontal scanning period of the read horizontal synchronizing signal HS at the level H (FIG. 10(*c*1)). The selection control signal MXS is kept at the level H in the clock periods corresponding to odd-numbered pixels on each horizontal line (odd pixels), while being kept at the level L in the clock periods corresponding to even-numbered pixels on each horizontal line (even pixels). The multiplexer 550 (see FIG. 2) accordingly outputs the read image data in the clock periods corresponding to the odd-numbered pixels on each horizontal line and the mask data in the clock periods corresponding to the even-numbered pixels on each horizontal line, as the driving image data signal DVDS (FIG. 10(*g*1)).

In the second field period, the selection control signal MXS (FIG. 10(*f*2)) alternately varies between the level L and the level H at the clock period of the read clock DCK (FIG. 10(*d*2)) during each horizontal scanning period of the read horizontal synchronizing signal HS at the level H (FIG. 10(*c*2)). The selection control signal MXS is kept at the level L in the clock periods corresponding to odd-numbered pixels on each horizontal line (odd pixels), while being kept at the level H in the clock periods corresponding to even-numbered pixels on each horizontal line (even pixels). The multiplexer 550 (see FIG. 2) accordingly outputs the mask data in the clock periods corresponding to the odd-numbered pixels on each horizontal line and the read image data in the clock periods corresponding to the even-numbered pixels on each horizontal line, as the driving image data signal DVDS (FIG. 10(*g*2)).

As described above, the driving image data generation module of this modified example replaces the read image data of the first field corresponding to the even-numbered pixels on each horizontal line with the mask data, while replacing the read image data of the second field corresponding to the odd-numbered pixels on each horizontal line with the mask data. The first driving image data is thus generated by replacing the read image data of the first field corresponding to the even-numbered vertical lines with the mask data, whereas the second driving image data is generated by replacing the read image data of the second field corresponding to the odd-numbered vertical lines. The mask data and the image data are thus alternately input at the field period Tfi into each vertical line of the liquid crystal panel. Namely the image expressed by the mask data is displayed momentarily in each pixel, prior to display of a next image expressed by newly generated read image data. This technique desirably decreases the potential effects of a previously displayed image on the newly displayed image, thus effectively reducing blur of a moving image to the equivalent level to that attained by the prior art technique.

The system of the third modified example replaces the read image data corresponding to the pixels on selected vertical lines with the mask data, whereas the system of the first embodiment replaces the read image data corresponding to selected horizontal lines with the mask data. The technique of the third modified example more effectively reduces blur of a moving image having motions in the horizontal direction, compared with the technique of the first embodiment. The technique of the first embodiment, on the other hand, more effectively reduces blur of a moving image having motions in the vertical direction, compared with the technique of the third modified example.

As described previously in the first embodiment, the mask data used in this third modified example is not the simple black image data but is the image data obtained by the preset operation of the original image data according to the amount of motion in the image. This arrangement desirably prevents reduction of the actual luminance of the displayed image.

The techniques of the first modified example and the second modified example discussed above may be combined with the technique of the third modified example.

A4.4. Modified Example 4

Figure 11:
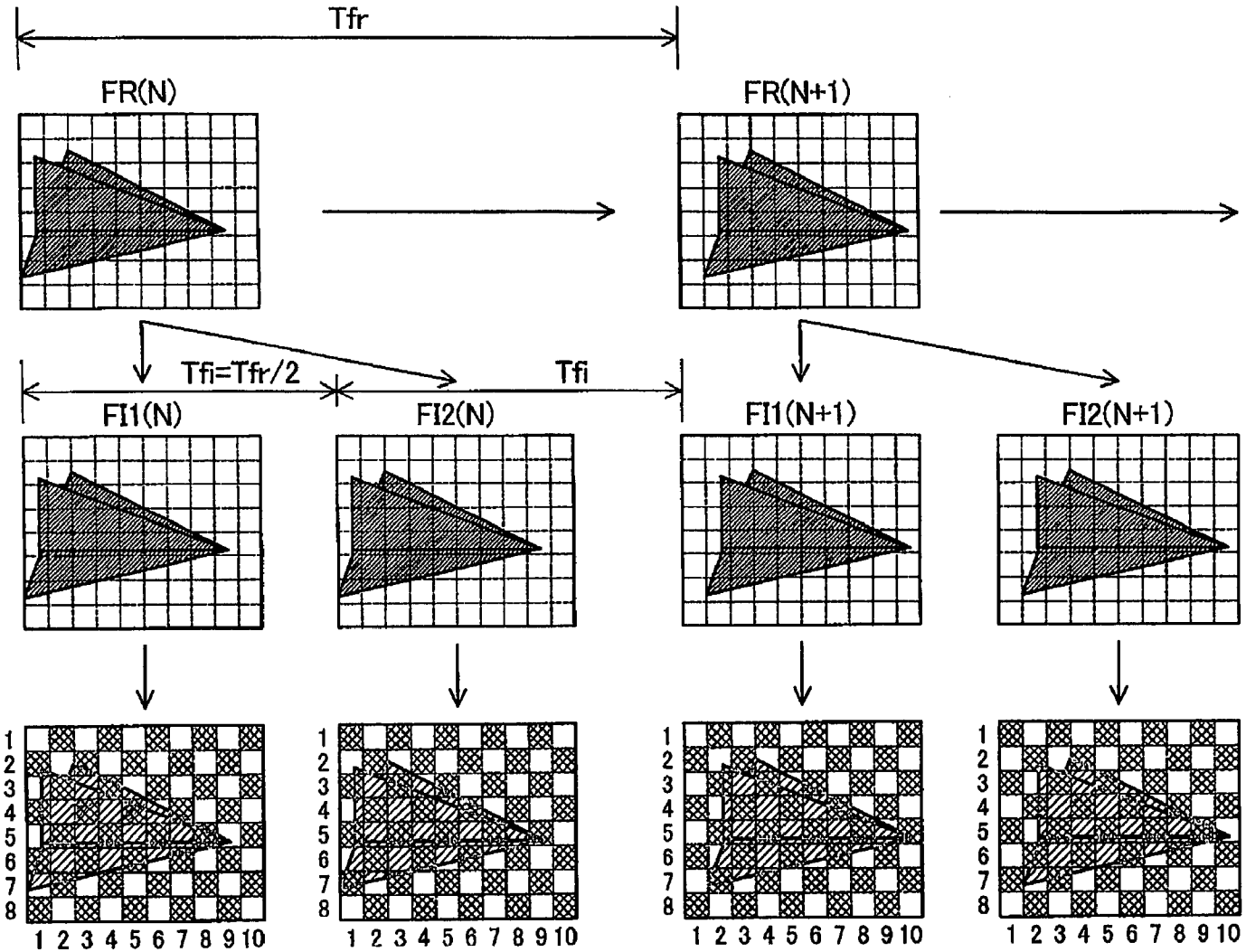
FIG. 11 shows generation of driving image data in a fourth modified example.

FIG. 11 shows generation of driving image data in a fourth modified example. Like the first embodiment shown in FIG. 5, each frame image data is stored at the frame period Tfr into the frame memory 20. In the illustrated example of FIG. 11(*a*), frame image data FR(N) of an N-th frame is stored into the frame memory 20.

In the fourth modified example, the memory read control module reads image data of one frame twice from the storage of the frame memory 20 at the field period Tfi, which is half the frame period Tfr, and sequentially outputs the two read image data as read image data FI1 of a first field and read image data FI2 of a second field, as shown in FIG. 11(*b*).

As shown in FIG. 11(*c*), the driving image data generation module of the fourth modified example generates first driving image data by replacement of the read image data FI1 of the first field corresponding to even-numbered pixels (2,4,6,8, . . . ) on odd-numbered horizontal lines (1,3,5,7, . . . ) with mask data (crosshatched areas) and replacement of the read image data FI1 of the first field corresponding to odd-numbered pixels (1,3,5,7, . . . ) on even-numbered horizontal lines (2,4,6,8, . . . ) with mask data. Namely the first driving image data has mask data arranged in checkered pattern. The driving image data generation module of this modified example also generates second driving image data by replacement of the read image data FI2 of the second field corresponding to odd-numbered pixels (1,3,5,7, . . . ) on odd-numbered horizontal lines (1,3,5,7, . . . ) with mask data and replacement of the read image data FI2 of the second field corresponding to even-numbered pixels (2,4,6,8, . . . ) on even-numbered horizontal lines (2,4,6,8, . . . ) with mask data. Namely the second driving image data has mask data arranged in complementary checkered pattern to that of the first driving image data. The alternate current drive may be attained by application of the positive polarity (+) to read image data FI1(N) of the first field and read image data FI2(N) of the second field in the N-th frame and application of the negative polarity (−) to read image data FI1(N+1) of the first field and read image data FI2(N+1) of the second field in a next (N+1)-th frame.

One possible modification may alternatively replace the read image data FI1 of the first field corresponding to odd-numbered pixels on odd-numbered horizontal lines and even-numbered pixels on even-numbered horizontal lines with mask data, while replacing the read image data FI2 of the second field corresponding to even-numbered pixels on odd-numbered horizontal lines and odd-numbered pixels on even-numbered horizontal lines with mask data.

For the simplicity of explanation, in the illustrated image of FIG. 11 expressed by the driving image data, each frame image consists of only 8 horizontal lines and 10 vertical lines and is thus shown as a discrete image. In an actual image, however, each frame image consists of several hundred horizontal lines and vertical lines. Such discreteness is hardly recognizable by the human vision.

As described above, the driving image data generation module of this modified example replaces the read image data of the first field corresponding to the even-numbered pixels on the odd-numbered horizontal lines and the odd-numbered pixels on the even-numbered horizontal lines with the mask data, while replacing the read image data of the second field corresponding to the odd-numbered pixels on the odd-numbered horizontal lines and the even-numbered pixels on the even-numbered horizontal lines with the mask data. The mask data and the image data are thus alternately input at the field period Tfi into each pixel of the liquid crystal panel. Namely the image expressed by the mask data is displayed momentarily in each pixel, prior to display of a next image expressed by newly generated read image data. This technique desirably decreases the potential effects of a previously displayed image on the newly displayed image, thus effectively reducing blur of a moving image to the equivalent level to that attained by the prior art technique.

The arrangement of the mask data in the checkered pattern has both the effect of the first embodiment to reduce blur of a moving image including motions in the vertical direction and the effect of the third modified example to reduce blur of a moving image including motions in the horizontal direction. The technique of the fourth modified example gives the finer arrangement of the mask data in the checkered pattern, compared with the mask data in the horizontal lines in the first embodiment and with the mask data in the vertical lines in the third modified example. This arrangement desirably prevents the afterimage on the retinas, thus ensuring the effective reduction of blur of a moving image.

As described previously in the first embodiment, the mask data used in this fourth modified example is not the simple black image data but is the image data obtained by the preset operation of the original image data according to the amount of motion in the image. This arrangement desirably prevents reduction of the actual luminance of the displayed image.

The techniques of the first modified example and the second modified example discussed above may be combined with the technique of the fourth modified example.

A4.5. Modified Example 5

Figure 12:
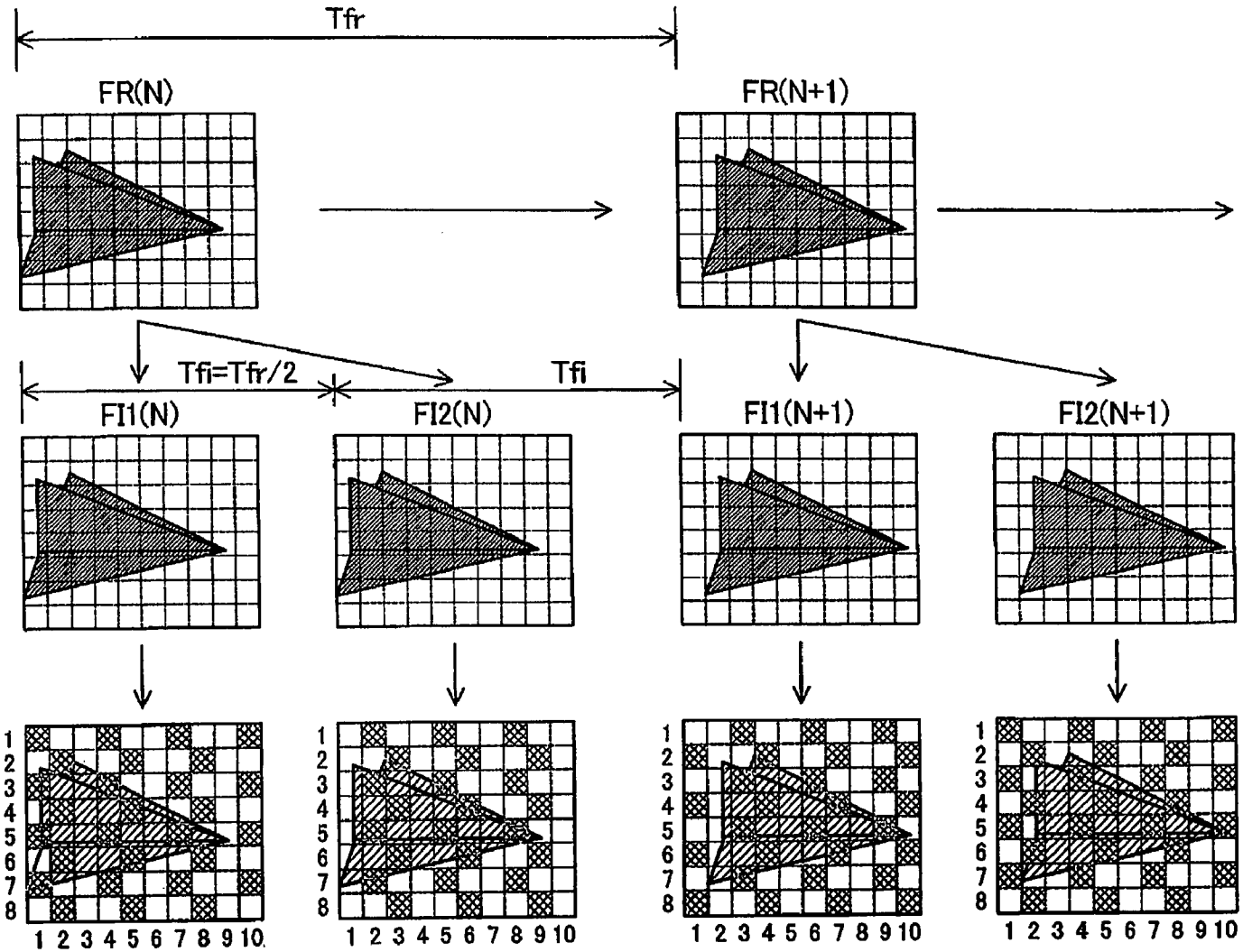
FIG. 12 shows generation of driving image data in a fifth modified example.

FIG. 12 shows generation of driving image data in a fifth modified example. Like the first embodiment shown in FIG. 5, each frame image data is stored at the frame period Tfr into the frame memory 20. In the illustrated example of FIG. 12(*a*), frame image data FR(N) of an N-th frame is stored into the frame memory 20.

In the fifth modified example, the memory read control module reads image data of one frame twice from the storage of the frame memory 20 at the field period Tfi, which is half the frame period Tfr, and sequentially outputs the two read image data as read image data FI1 of a first field and read image data FI2 of a second field, as shown in FIG. 12(*b*).

As shown in FIG. 12(*c*), the driving image data generation module of the fifth modified example generates first driving image data by replacement of read image data FI1(N) of the first field in the N-th frame corresponding to (3I+1)-th pixels (where I is an integer of not less than 0) (1,4,7,10, . . . ) on odd-numbered horizontal lines (1,3,5,7, . . . ) with mask data (crosshatched areas) and replacement of the read image data FI1(N) of the first field in the N-th frame corresponding to (3I+2)-th pixels (2,5,8,11, . . . ) on even-numbered horizontal lines (2,4,6,8, . . . ) with mask data.

The driving image data generation module of this modified example also generates second driving image data by replacement of read image data FI2(N) of the second field in the N-th frame corresponding to (3I+2)-th pixels (2,5,8,11, . . . ) on odd-numbered horizontal lines (1,3,5,7, . . . ) with mask data and replacement of the read image data FI2(N) of the second field in the N-th frame corresponding to 3I-th pixels (3,6,9, 12, . . . ) on even-numbered horizontal lines (2,4,6,8, . . . ) with mask data.

The driving image data generation module of this modified example further generates third driving image data by replacement of read image data FI1(N+1) of the first field in a next (N+1)-th frame corresponding to 3I-th pixels (3,6,9, 12, . . . ) on odd-numbered horizontal lines (1,3,5,7, . . . ) with mask data and replacement of the read image data FI1(N+1) of the first field in the (N+1)-th frame corresponding to (3I+1)-th pixels (1,4,7,10, . . . ) on even-numbered horizontal lines (2,4,6,8, . . . ) with mask data.

The driving image data generation module of this modified example generates first driving image data again by replacement of read image data FI2(N+1) of the second field in the (N+1)-th frame corresponding to (3I+1)-th pixels (1,4,7, 10, . . . ) on odd-numbered horizontal lines (1,3,5,7, . . . ) with mask data and replacement of the read image data FI2(N+1) of the second field in the (N+1)-th frame corresponding to (3I+2)-th pixels (2,5,8,11, . . . ) on even-numbered horizontal lines (2,4,6,8, . . . ) with mask data.

Generation of the driving image data is not restricted to the sequence of the first, the second, and the third driving image data. The driving image data may be generated in any sequence, for example, in the sequence of the first, the third, and the second driving image data or in the sequence of the second, the first, and the third driving image data.

For the simplicity of explanation, in the illustrated image of FIG. 12 expressed by the driving image data, each frame image consists of only 8 horizontal lines and 10 vertical lines and is thus shown as a discrete image. In an actual image, however, each frame image consists of several hundred horizontal lines and vertical lines. Such discreteness is hardly recognizable by the human vision.

As described above, the system of the fifth modified example inputs the mask data into each pixel of the liquid crystal panel at the rate of 1 to 3 fields. This technique decreases the potential effects of a previously displayed image on a newly displayed image after input of the mask data and thus reduces blur of a moving image.

The technique of the fifth modified example has the less effects of reducing blur of a moving image, compared with the technique of the fourth modified example that uses mask data arranged in the checkered pattern. The technique of the fifth modified example, however, still has both the effect of the first embodiment to reduce blur of a moving image including motions in the vertical direction and the effect of the third modified example to reduce blur of a moving image including motions in the horizontal direction.

As described previously in the first embodiment, the mask data used in this fifth modified example is not the simple black image data but is the image data obtained by the preset operation of the original image data according to the amount of motion in the image. This arrangement desirably prevents reduction of the actual luminance of the displayed image. The system of the fifth modified example replaces the read image data with the mask data at the rate of 1 to 3 pixels and accordingly has the better effect of preventing reduction of the actual luminance of the displayed image, compared with any of the first embodiment and the first to the fourth modified examples.

A4.6. Modified Example 6

Figure 13:
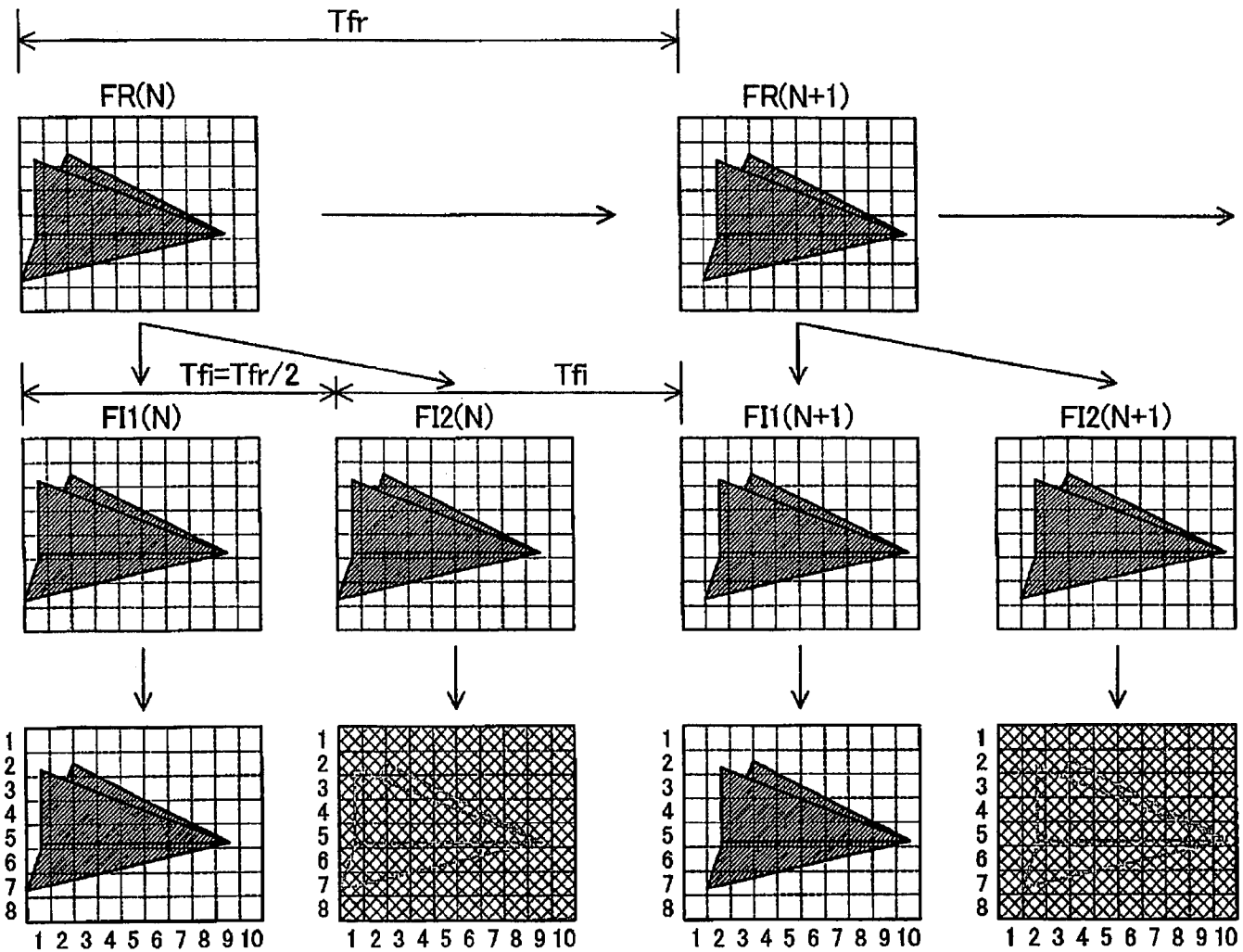
FIG. 13 shows generation of driving image data in a sixth modified example.

FIG. 13 shows generation of driving image data in a sixth modified example. Like the first embodiment shown in FIG. 5, each frame image data is stored at the frame period Tfr into the frame memory 20. In the illustrated example of FIG. 13(*a*), frame image data FR(N) of an N-th frame is stored into the frame memory 20.

In the sixth modified example, the memory read control module reads image data of one frame twice from the storage of the frame memory 20 at the field period Tfi, which is half the frame period Tfr, and sequentially outputs the two read image data as read image data FI1 of a first field and read image data FI2 of a second field, as shown in FIG. 13(*b*).

As shown in FIG. 13(*c*), the driving image data generation module of the sixth modified example replaces the read image data FI2 of the second field corresponding to all the pixels with mask data, while not replacing the read image data FI1 of the first field.

As described above, the system of the sixth modified example replaces the read image data of the second field corresponding to all the pixels with mask data, while not replacing the read image data of the first field. The mask data and the image data are thus alternately input at the field period Tfi into each pixel of the liquid crystal panel. Namely the image expressed by the mask data is displayed momentarily in each pixel, prior to display of a next image expressed by newly generated read image data. This technique desirably decreases the potential effects of a previously displayed image on the newly displayed image, thus effectively reducing blur of a moving image to the equivalent level to that attained by the prior art technique.

As described previously in the first embodiment, the mask data used in this sixth modified example is not the simple black image data but is the image data obtained by the preset operation of the original image data according to the amount of motion in the image. This arrangement desirably prevents reduction of the actual luminance of the displayed image.

The techniques of the first modified example and the second modified example discussed above may be combined with the technique of the sixth modified example.

A4.7. Modified Example 7

In the driving image data of the first embodiment, the read image data and the mask data are arranged alternately on every other horizontal line. The read image data and the mask data may be arranged alternately on every 'm' horizontal lines, where 'm' is an integer of not less than 1.

In the driving image data of the third modified example, the read image data and the mask data are arranged alternately on every other vertical line. The read image data and the mask data may be arranged alternately on every 'n' vertical lines, where 'n' is an integer of not less than 1.

In the driving image data of the fourth modified example, the read image data and the mask data are arranged alternately in every other pixel in both the horizontal direction and the vertical direction. The read image data and the mask data may be arranged alternately in every block defined by 'p' pixels in the horizontal direction and 'q' pixels in the vertical direction, where 'p' and 'q' are both integers of not less than 1, in both the horizontal direction and the vertical direction.

In the driving image data of the fifth modified example, the read image data is replaced with the mask data at the rate of 1 to 3 pixels aligned on each horizontal line, and the positions of the mask data are shifted at the cycle of three horizontal lines. The read image data may be replaced with the mask data at a rate of 's' consecutive pixels to 'r' pixels aligned on each horizontal line, where 'r' is an integer of not less than 3 and s is an aliquot of 'r'. The positions of the mask data in the 's' pixels among the 'r' pixels may be shifted at a cycle of 't' horizontal lines, where 't' is an integer of not less than 1.

B. Second Embodiment

Figure 14:
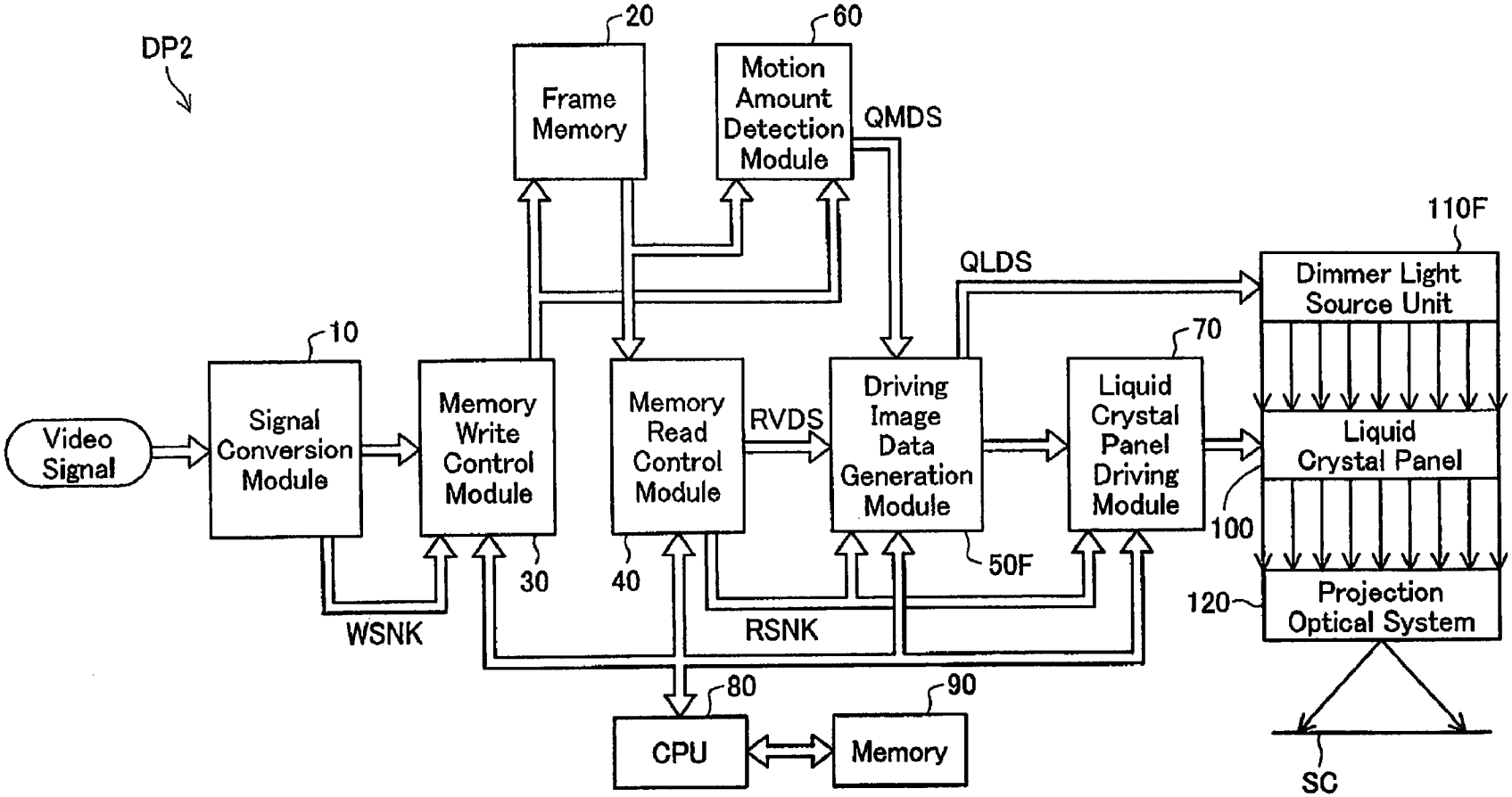
FIG. 14 is a block diagram schematically illustrating the configuration of an image display system including an image data processing device in a second embodiment of the invention.

FIG. 14 is a block diagram schematically illustrating the configuration of an image display system DP2 including an image data processing device in a second embodiment of the invention. The image display system DP2 of the second embodiment has the similar configuration to that of the image display system DP1 of the first embodiment shown in FIG. 1, except that the light source unit 110 is replaced by a dimmer light source unit 110F and that the driving image data generation module 50 is replaced by a driving image data generation module 50F, which outputs dimmer data to control the operations of the dimmer light source unit 110F. Only the different structure is described below.

Figure 15:
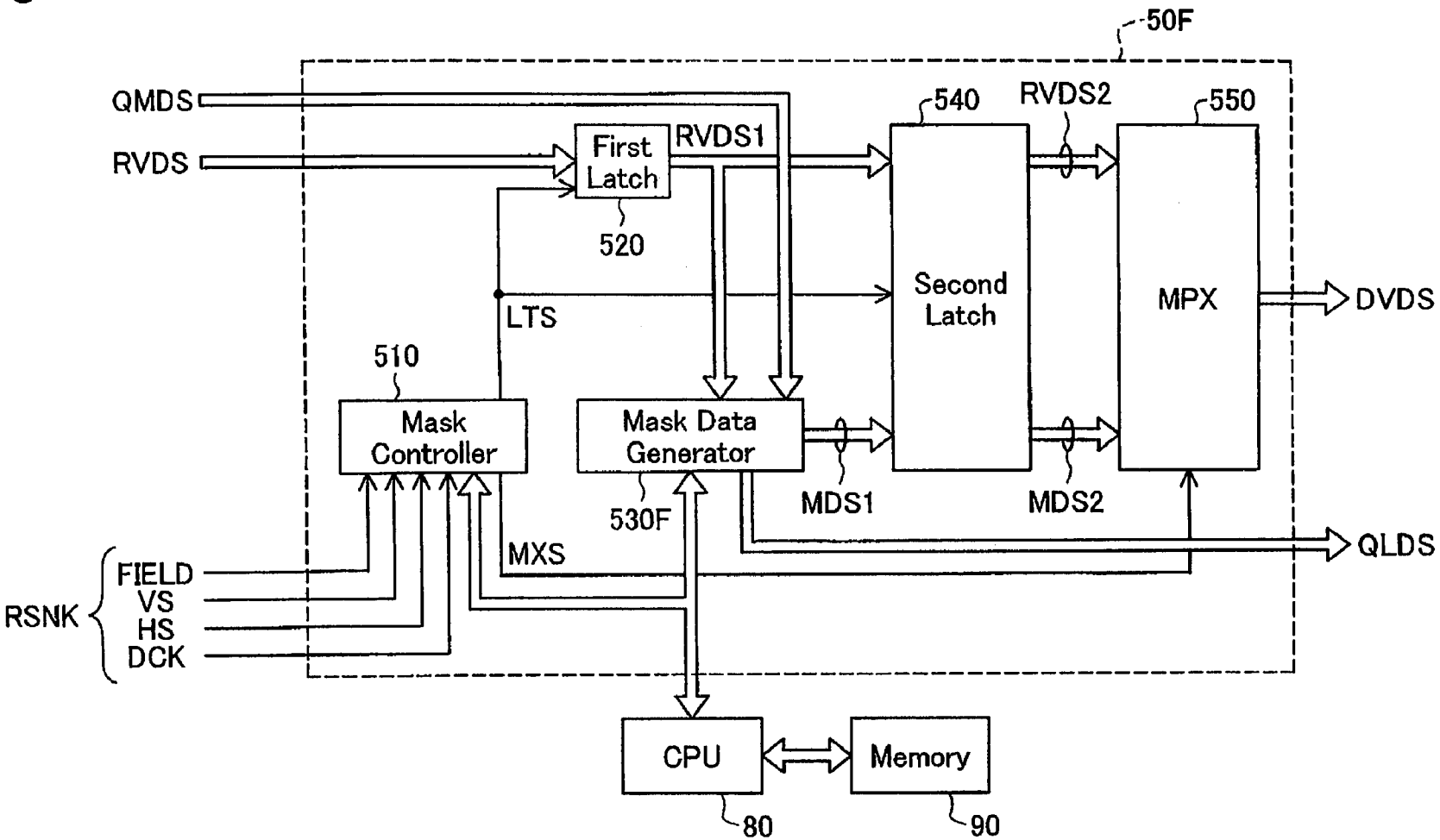
FIG. 15 is a block diagram schematically illustrating the structure of a driving image data generation module included in the image data processing device of the image display system shown in FIG. 14.

FIG. 15 is a block diagram schematically illustrating the structure of the driving image data generation module 50F. The driving image data generation module 50F of the second embodiment has the similar structure to that of the driving image data generation module 50 of the first embodiment shown in FIG. 2, except that the mask data generator 530 is replaced by a mask data generator 530F that outputs dimmer data QLDS to control the operations of the dimmer light source unit 110F.

Figure 16:
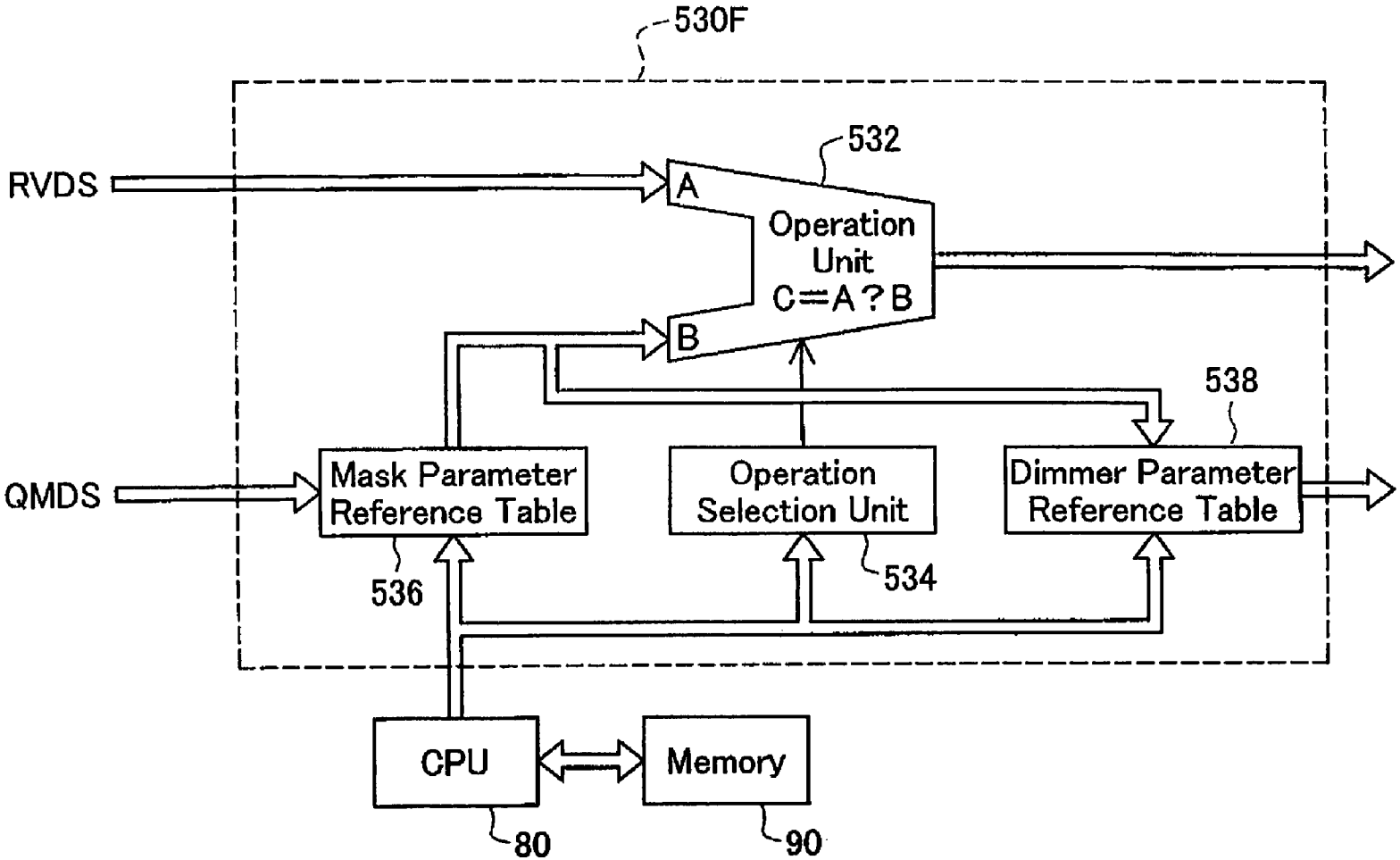
FIG. 16 is a block diagram schematically illustrating the structure of a mask data generator included in the driving image data generation module of FIG. 15.

FIG. 16 is a block diagram schematically illustrating the structure of the mask data generator 530F. The mask data generator 530F of the second embodiment has a dimmer parameter reference table 538, in addition to the structure of the mask data generator 530 of the first embodiment shown in FIG. 3.

The dimmer parameter reference table 538 stores table data, which is read and supplied from the memory 90 by the CPU 90 and shows a variation in value of a dimmer parameter KL in relation to the amount of motion of the image. Like the mask parameter reference table 536, the dimmer parameter reference table 538 refers to this stored table data, specifies the value of the dimmer parameter KL corresponding to the amount of motion expressed by the motion amount data signal QMDS output from the motion amount detection module 60, and outputs a dimmer data signal QLDS representing the specified value of the dimmer parameter KL to the dimmer light source unit 110F.

Figure 17A:
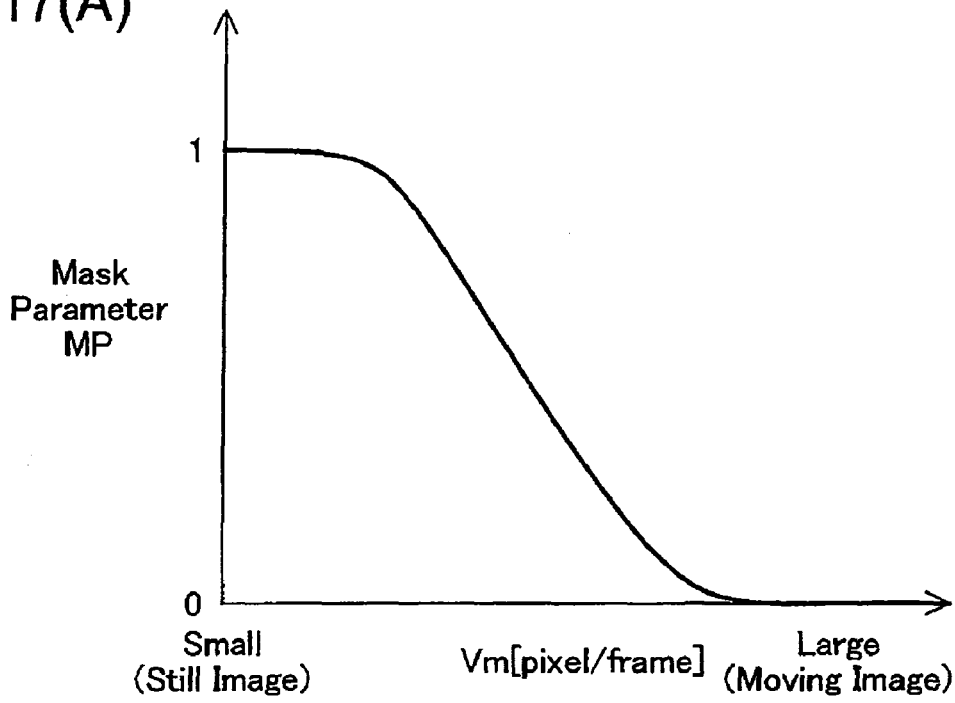
FIG. 17 shows table data stored in a mask parameter reference table and a dimmer parameter reference table included in the mask data generator of FIG. 16.
Figure 17B:
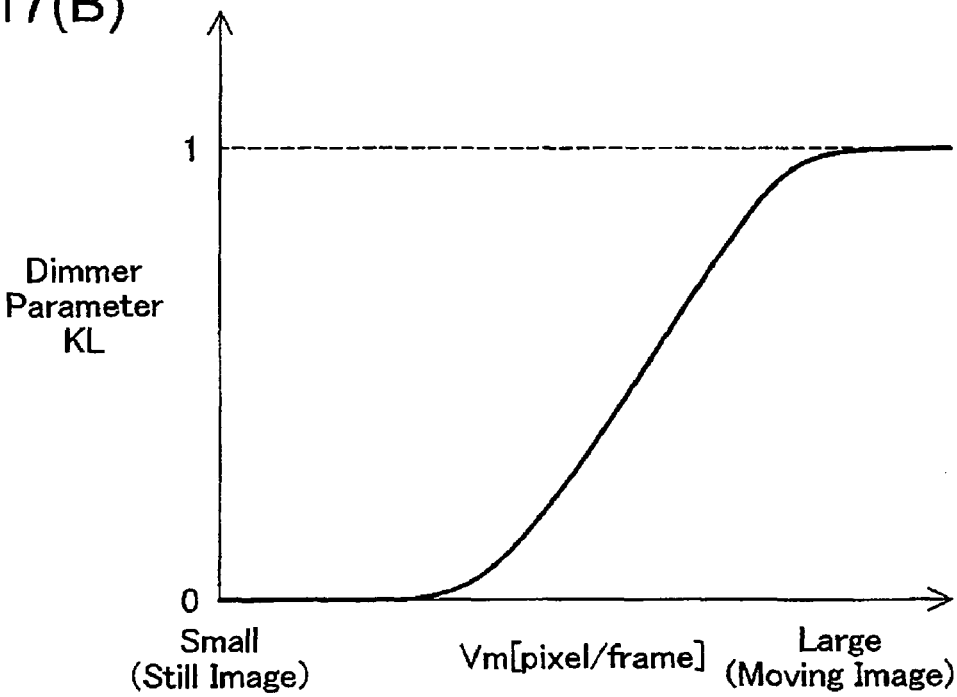

FIG. 17 shows the table data stored in the mask parameter reference table 536 and the dimmer parameter reference table 538. FIG. 17(A) shows a characteristic curve of the table data stored in the mask parameter reference table 536, that is, a characteristic curve of the mask parameter MP (in a value range of 0 to 1) against the amount of motion Vm. FIG. 17(B) shows a characteristic curve of the table data stored in the dimmer parameter reference table 538, that is, a characteristic curve of the dimmer parameter KL (in a value range of 1 to 0) against the amount of motion Vm. The greater amount of motion Vm reflects the quicker motion of the image and may lead to the greater degree of image blur. The mask parameter reference table 536 is set to vary the mask parameter MP in the value range of 0 to 1 and give the smaller value corresponding to the greater amount of motion Vm and the greater value corresponding to the smaller amount of motion Vm, as shown in FIG. 17(A). The greater amount of motion Vm thus gives the smaller value of the mask parameter MP and the smaller value of generated mask data and leads to reduction of the luminance of a displayed image from the theoretical luminance. The dimmer parameter reference table 538 is set to vary the dimmer parameter KL in the value range of 1 to 0 and give the greater value corresponding to the greater amount of motion Vm and the smaller value corresponding to the smaller amount of motion Vm, as shown in FIG. 17(B). The dimmer light source unit 110 computes a luminance EL from the dimmer parameter KL supplied in the form of the dimmer data signal QLDS according to Equations (1) and (2) given below:

$$EL=EA+EB\times KL \tag{1}$$

$$EL\text{max}=EA+EB \tag{2}$$

where ELmax denotes a maximum possible luminance output from the dimmer light source unit 110F, EA denotes a base luminance as a fixed component of the maximum luminance ELmax regardless of the value of the dimmer parameter KL, and EB denotes a dimmer luminance as a variable component of the maximum luminance ELmax with a variation in value of the dimmer parameter KL.

In the image with no motion, the luminance EL of the dimmer light source unit 110F is equal to the base luminance EA. In the image with a motion, the luminance EL of the dimmer light source unit 110F is raised by the value (EB× KL), where the dimmer parameter KL increases with an increase in amount of motion Vm. This arrangement effectively compensates for reduction of the luminance of the displayed image according to the amount of motion.

The dimmer light source unit 110F of this embodiment has one light source outputting the maximum possible luminance ELmax, which includes the base luminance EA as the fixed component regardless of the value of the dimmer parameter KL and the dimmer luminance EB as the variable component with a variation in value of the dimmer parameter KL. This structure is, however, not restrictive in any sense. In one modified structure, for example, the dimmer light source unit may have a main light source outputting the base luminance EA as the fixed component and an auxiliary light source outputting the dimmer luminance EB as the variable component. The dimmer luminance EB of the auxiliary light source is regulated according to the dimmer parameter KL.

The driving image data generation module 50F of the second embodiment may generate any of the driving image data in the first embodiment and the first to the seventh modified examples described previously, although the detailed description is omitted.

C. Third Embodiment

Figure 18:
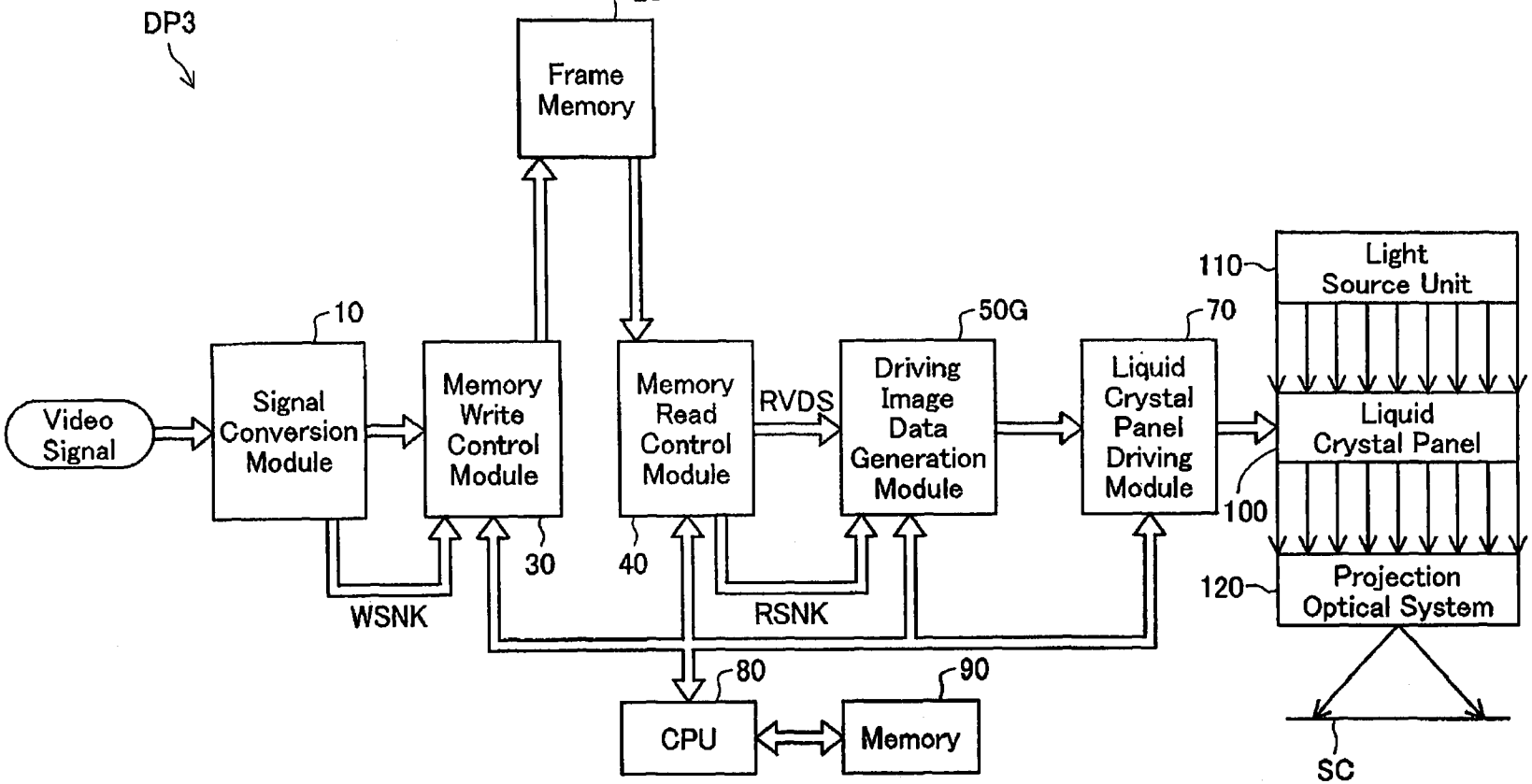
FIG. 18 is a block diagram schematically illustrating the configuration of an image display system including an image data processing device in a third embodiment of the invention.

FIG. 18 is a block diagram schematically illustrating the configuration of an image display system DP3 including an image data processing device in a third embodiment of the invention. The image display system DP3 of the third embodiment has the similar configuration to that of the image display system DP1 of the first embodiment shown in FIG. 1, except that the motion amount detection module 60 is omitted and that the driving image data generation module 50 is accordingly replaced by a driving image data generation module 50G. Only the different structure is described below.

Figure 19:
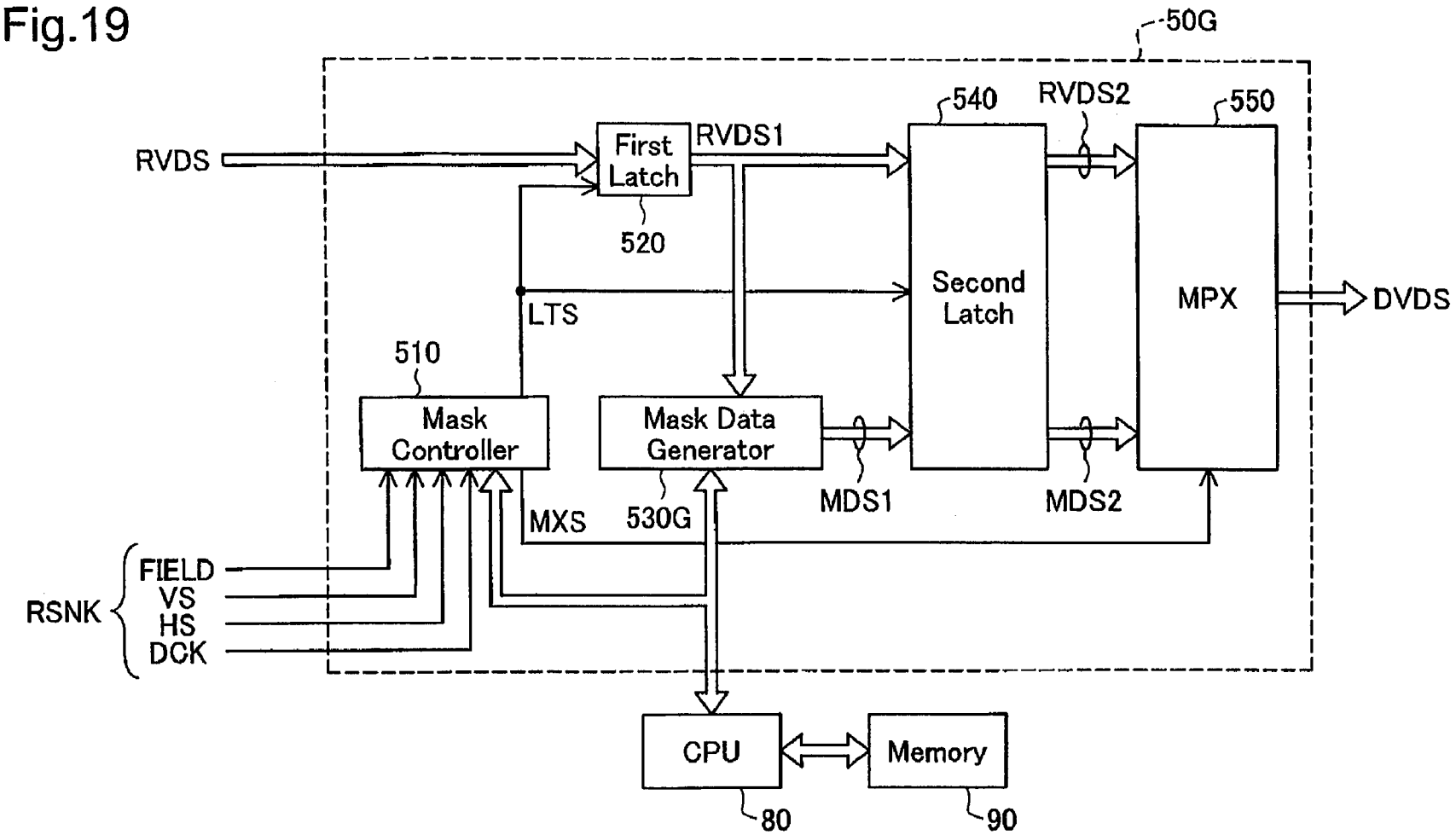
FIG. 19 is a block diagram schematically illustrating the structure of a driving image data generation module included in the image data processing device of the image display system shown in FIG. 18.

FIG. 19 is a block diagram schematically illustrating the structure of the driving image data generation module 50G. The driving image data generation module 50G of the third embodiment has the similar structure to that of the driving image data generation module 50 of the first embodiment shown in FIG. 2, except that the mask data generator 530 is replaced by a mask data generator 530G that does not have input of the motion amount data signal QMDS.

Figure 20:
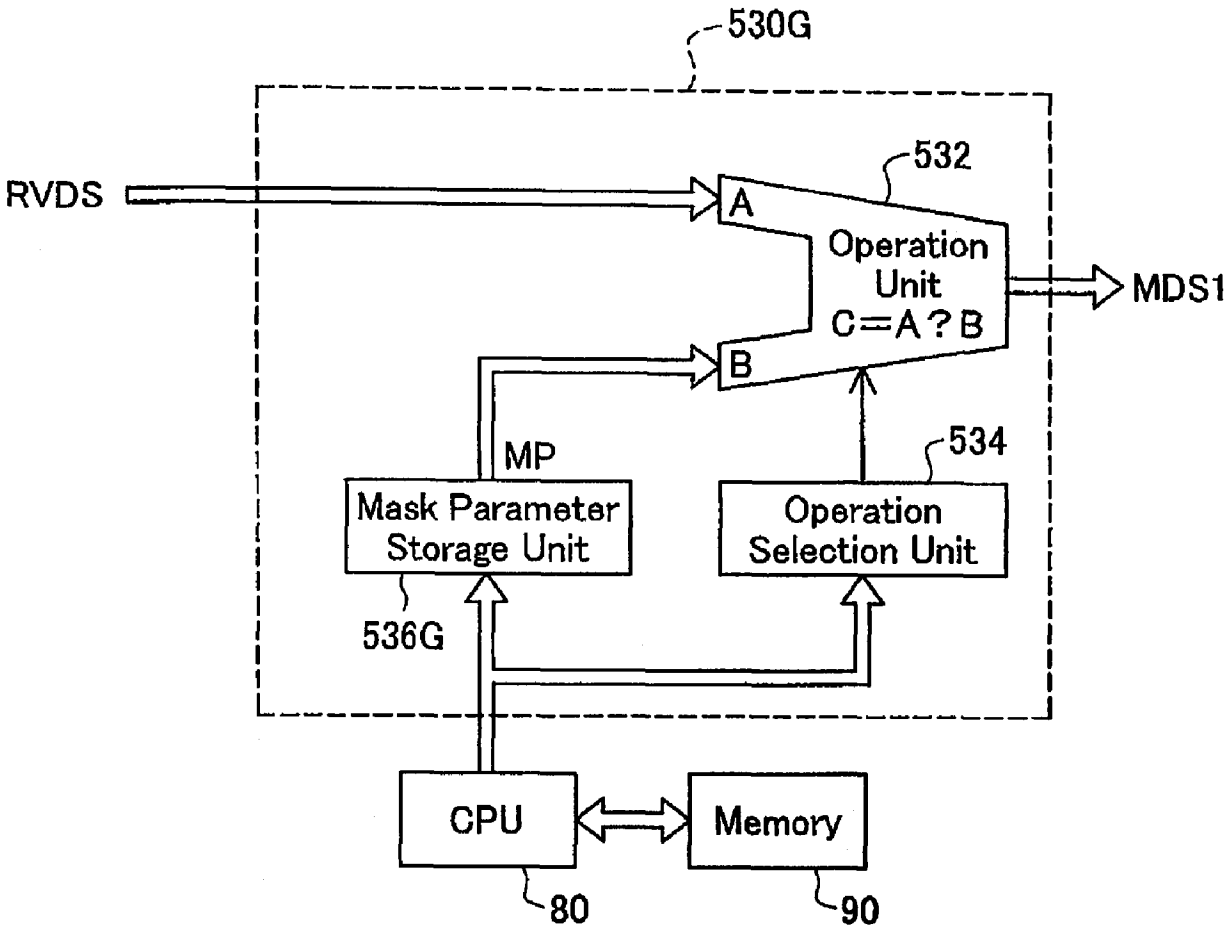
FIG. 20 is a block diagram schematically illustrating the structure of a mask data generator included in the driving image data generation module of FIG. 19.

FIG. 20 is a block diagram schematically illustrating the structure of the mask data generator 530G. The mask data generator 530G of the third embodiment has the similar structure to that of the mask data generator 530 of the first embodiment shown in FIG. 3, except that the mask parameter reference table 536 is replaced by a mask parameter storage unit 536G.

In the mask data generator 530 of the first embodiment, the mask parameter reference table 536 stores the table data set by the CPU 80 and refers to the stored table data to specify the value of the mask parameter MP. In the mask data generator 530G of the third embodiment, on the other hand, the mask parameter storage unit 536G directly stores the value of the mask parameter MP specified and set by the CPU 80. The memory 90 stores the table data representing a variation in value of the mask parameter MP against the amount of motion Vm in the image. In response to the user's setting of a desired amount of motion, the CPU 80 refers to the stored table data, specifies the value of the mask parameter MP corresponding to the user's desired amount of motion, and sets the specified value of the mask parameter MP in the mask parameter storage unit 536G.

Any technique may be applied to allow the user to specify the desired amount of motion in the image, for example, a large degree of motion, a medium degree of motion, and a small degree of motion in a motion preference mode. In this case, the table data has the values of the mask parameter MP corresponding to the respective degrees of motion.

The arrangement of the third embodiment reduces blur of a moving image, while preventing reduction of the actual luminance of a displayed image, like the first embodiment.

The driving image data generation module 50G of the third embodiment may generate any of the driving image data in the first embodiment and the first to the seventh modified examples described previously, although the detailed description is omitted. The driving image data generation module 50G of the third embodiment may additionally have the dimmer light source unit of the second embodiment to regulate the luminance according to the amount of motion in the image.

D. Fourth Embodiment

D1. General Configuration of Image Display System

An image display system including an image data processing device in a fourth embodiment of the invention has the same configuration as the image display system DP1 of the first embodiment shown in FIG. 1. The components of the image display system of the fourth embodiment are thus not specifically described here.

In the image display system of the fourth embodiment, the motion amount detection module 60 compares the image data of each frame sequentially written into the frame memory 20 (hereafter referred to as 'frame image data') with read image data of the corresponding frame read from the frame memory 20 (that is, read image data of the corresponding frame including a first field and a second field as discussed later) to detect an amount of motion of the image. The detected amount of motion is output as the motion amount data signal QMDS to the driving image data generation module 50.

A concrete procedure of detecting the amount of motion first divides both the frame image data (target image data) written into the frame memory 20 and the frame image data (reference image data) read from the frame memory 20 into rectangular pixel blocks of 'p' pixels by 'q' pixels, where 'p' and 'q' are both integers of not less than 2. The procedure specifies a motion vector of each block representing a motion between two adjoining frames and sets the magnitude of the motion vector to the amount of motion in the block. The amounts of motion in all the blocks are summed up to give the amount of motion of the image between the two adjoining frames. The motion vector of each block may be specified by any of known techniques, for example, the technique of determining a moving distance (a variation of the coordinate values) of the center of gravity in pixel data (luminance data) of the block. The details of the available techniques are not specifically described here.

The liquid crystal panel driving module 70 converts the read synchronizing signal RSNK supplied from the memory read control module 40 and the driving image data signal DVDS supplied from the driving image data generation module 50 into signals in a suppliable form to the liquid crystal panel 100 and supplies the converted signals to the liquid crystal panel 100.

D2. Structure and Operations of Driving Image Data Generation Module

The driving image data generation module 50 of the fourth embodiment has the same structure as the driving image data generation module 50 of the first embodiment shown in FIG. 2. The components of the driving image data generation module 50 of the fourth embodiment are thus not specifically described here.

The multiplexer 550 selects either of the read image data signal RVDS2 and the mask data signal MDS2 in response to the selection control signal MXS output from the mask controller 510 and outputs the selected signal as the driving image data signal DVDS to the liquid crystal panel driving module 70 (see FIG. 1).

The mask data generator 530 of the fourth embodiment has the same structure as the mask data generator 530 of the first embodiment shown in FIG. 3. The components of the mask data generator 530 of the fourth embodiment are thus not specifically described here.

The mask parameter reference table 536 stores table data, which is read and supplied from the memory 90 by the CPU 90 and shows a variation in value of a mask parameter MP in relation to the normalized amount of motion of the image (hereafter referred to as 'mask parameter characteristic'). The mask parameter reference table 536 refers to this stored table data, specifies the value of the mask parameter MP corresponding to the amount of motion Vm expressed by the motion amount data signal QMDS output from the motion amount detection module 60, and outputs data representing the specified value of the mask parameter MP to the operation unit 532. The table data may be replaced by function operation of a polynomial approximation.

The mask parameter characteristic shown by the table data stored in the mask parameter reference table 536 will be described later in detail.

The operation unit 532 sets the read image data included in the input read image data signal RVDS1 to an operation parameter A and the specified value of the mask parameter MP output from the mask parameter reference table 536 to an operation parameter B, and performs the selected operation (A?B: where ? denotes an operator representing the selected operation) by the operation selection unit 534. The operation unit 532 outputs the result of the operation C (=A?B) as the mask data signal MDS1. The mask data with regard to each pixel of a certain frame expressed by the input read image data RVDS1 is accordingly generated corresponding to the amount of motion in the certain frame and the read image data of the pixel.

For example, multiplication (C=A*B) is selectively set as the operation performed by the operation unit 532 as mentioned above. The operation unit 532 sets the operation parameter B to a value '0.3' of the mask parameter MP specified by the mask parameter reference table 536. When values '00h', '32h', and 'FFh' of the read image data included in the input read image data signal RVDS1 are set to the operation parameter A, the operation unit 532 outputs mask data having values '00h', '0Fh', and '4Ch' as the mask data signal MDS1. Namely the specified value of the mask parameter MP represents a ratio of the mask data to the pixel value of the read image data (attenuation ratio).

Generation of the driving image data is described with reference to FIG. 11. The memory write control module 30 (see FIG. 1) stores frame image data of each frame at a preset frame period Tfr into the frame memory 20 as shown in FIG. 11(*a*). In the illustrated example of FIG. 11(*a*), frame image data FR(N) of an N-th frame and frame image data FR(N+1) of an (N+1)-th frame are sequentially stored into the frame memory 20, where N is an integer of not less than 1.

The memory read control module 40 (see FIG. 1) reads frame image data twice from the storage of the frame memory 20 at a field period Tfi, which is half the frame period Tfr, and sequentially outputs the two frame image data as read image data FI1 of a first field and read image data FI2 of a second field, as shown in FIG. 11(*b*). In the illustrated example of FIG. 11(*b*), read image data FI1(N) of a first field and read image data FI2(N) of a second field in the N-th frame and read image data FI1(N+1) of a first field and read image data FI2(N+1) of a second field in the (N+1)-th frame are sequentially read and output from the frame memory 20.

As shown in FIG. 11(*c*), the driving image data generation module 50 (see FIG. 1) generates first driving image data by replacement of the read image data FI1 of the first field corresponding to even-numbered pixels (2,4,6,8, . . . ) on odd-numbered horizontal lines (1,3,5,7, . . . ) with mask data (crosshatched areas) and replacement of the read image data FI1 of the first field corresponding to odd-numbered pixels (1,3,5,7, . . . ) on even-numbered horizontal lines (2,4,6, 8, . . . ) with mask data. Namely the first driving image data has mask data arranged in checkered pattern. The driving image data generation module 50 also generates second driving image data by replacement of the read image data FI2 of the second field corresponding to odd-numbered pixels (1,3,5, 7, . . . ) on odd-numbered horizontal lines (1,3,5,7, . . . ) with mask data and replacement of the read image data FI2 of the second field corresponding to even-numbered pixels (2,4,6, 8, . . . ) on even-numbered horizontal lines (2,4,6,8, . . . ) with mask data. Namely the second driving image data has mask data arranged in complementary checkered pattern to that of the first driving image data. The alternate current drive may be attained by application of the positive polarity (+) to read image data FI1(N) of the first field and read image data FI2(N) of the second field in the N-th frame and application of the negative polarity (−) to read image data FI1(N+1) of the first field and read image data FI2(N+1) of the second field in a next (N+1)-th frame.

One possible modification may alternatively replace the read image data FI1 of the first field corresponding to odd-numbered pixels on odd-numbered horizontal lines and even-numbered pixels on even-numbered horizontal lines with mask data, while replacing the read image data FI2 of the second field corresponding to even-numbered pixels on odd-numbered horizontal lines and odd-numbered pixels on even-numbered horizontal lines with mask data.

For the simplicity of explanation, in the illustrated image of FIG. 11 expressed by the driving image data, each frame image consists of only 8 horizontal lines and 10 vertical lines and is thus shown as a discrete image. In an actual image, however, each frame image consists of several hundred horizontal lines and vertical lines. Such discreteness is hardly recognizable by the human vision.

As described above, the system of the fourth embodiment replaces the read image data of the first field corresponding to the even-numbered pixels on the odd-numbered horizontal lines and the odd-numbered pixels on the even-numbered horizontal lines with the mask data, while replacing the read image data of the second field corresponding to the odd-numbered pixels on the odd-numbered horizontal lines and the even-numbered pixels on the even-numbered horizontal lines with the mask data. The mask data and the image data are thus alternately input at the field period Tfi into each pixel of the liquid crystal panel. Namely the image expressed by the mask data is displayed momentarily in each pixel, prior to display of a next image expressed by newly generated read image data. This technique desirably decreases the potential effects of a previously displayed image on the newly displayed image, thus effectively reducing blur of a moving image to the equivalent level to that attained by the prior art technique.

D3. Setting Mask Parameter Characteristic

The mask parameter characteristic shown by the table data stored in the mask parameter reference table 536 is set according to the image quality characteristic and the contrast characteristic of a moving image as discussed below.

D3.1 Picture Quality Characteristic of Moving Image

A relation between the mask parameter MP and the picture quality of the moving image (hereafter referred to as 'moving image quality') is quantitatively measured by a line scroll method described below. In the description, this relation is expressed as 'moving image quality characteristic'.

(1) Line Scroll Method

Figures 21, 22:
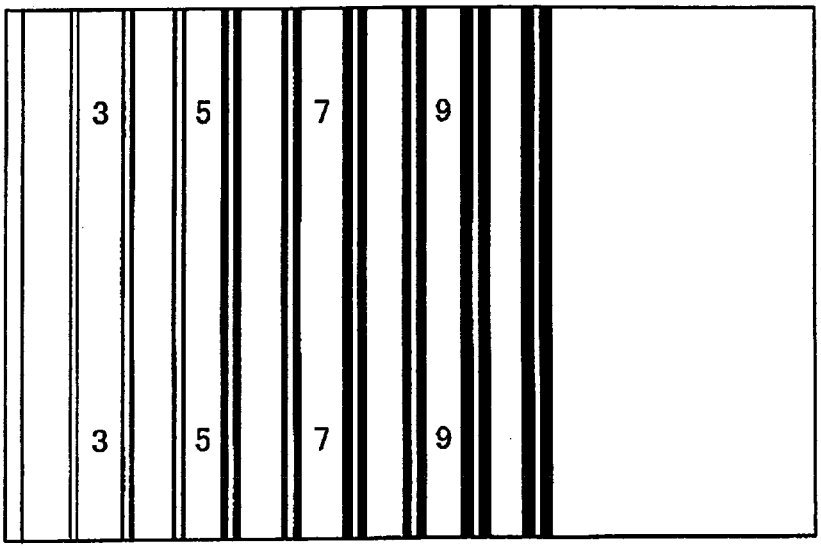
FIG. 21 shows a picture quality test image used for measurement of moving image quality by a line scroll method.
FIG. 22 shows measurement conditions adopted for evaluation of the moving image quality by the line scroll method.

FIG. 21 shows a picture quality test image used for measurement of the moving image quality by the line scroll method. The picture quality test image has ten sets of two vertical lines, where the line width and the line interval between the two vertical lines are gradually varied from 1 [pixel] to 10 [pixels] by the unit of 1 [pixel].

The line scroll method defines minimum recognizable line width and line interval in the displayed picture quality test image as a quantitative value of the image quality, displays a moving image by scrolling the displayed picture quality test image in a lateral direction, and specifies a minimum recognizable set of two vertical lines with the minimum recognizable line width and line interval. Such quantification of the moving image quality enables evaluation of the moving image quality. For example, when the specified minimum recognizable set of two vertical lines has the line width and line interval of 1 [pixel], the quantitative value of the moving image quality is equal to '1'. The quantitative value of the moving image quality is hereafter referred to as the 'line scroll (LS) value'.

FIG. 22 shows measurement conditions adopted for evaluation of the moving image quality by the line scroll method. The measurement conditions include the screen size, the viewing distance, the visual brightness, the input signal resolution, and the scroll amount. The screen size for projected display of the picture quality test image is 50 inches. The viewing distance of the image is 3H (H: vertical length of the displayed image) defined as 'HDTV standard viewing condition' by the Institute of Image Information and Television Engineers. The visual brightness is the brightness of default setting in an object device. The input signal resolution is SVGA (800×600), which is a standard resolution set for diversity of displays. The scroll amount is a parameter corresponding to the amount of motion Vm of a moving image and is expressed by the number of pixels moving in one frame [pixels/frame]. There are six scroll amounts 0, 3, 5, 8, 10, and 16 [pixels/frame]. The line scroll values are measured with these six scroll amounts and are averaged to an average line scroll value. The maximum scroll amount 16 [pixels/frame] is determined as described below.

The viewer's eye-tracking for perception of a moving image is defined by a viewing angle rate [degrees/second]. As is known in the art, the maximum possible speed θmax of eye-tracking in a short time period (hereafter referred to as the 'limit viewing angle rate θmax') is 30 [degrees/second]. This limit viewing angle rate θmax is assumed to show the perception limit of a moving image.

The limit viewing angle rate θmax is converted into a scroll amount α [pixels/frame] as:

$$fv\cdot\alpha\cdot(W/Xn)=2\cdot 3H\cdot\tan(\theta\max/2)$$

$$\alpha=2\cdot(1/fv)\cdot(3H/W)\cdot Xn\cdot\tan(\theta\max/2) \quad (3)$$

where fv, H, W, and Xn respectively denote the frame frequency, the vertical length of a displayed image, the lateral length of the displayed image, and the resolution in the lateral direction.

Substitution of 60 [Hz], ¾, 800 [pixels] and 30 [degrees/second] to the frame frequency fv, the aspect ratio H/W, Xn, and θmax in Equation (3) gives the scroll amount α of 16 [pixels/frame]. The scroll amount of greater than 16 [pixels/frame] exceeds the perception limit of a moving image. The maximum scroll amount at the viewing distance 3H is accordingly determined as 16 [pixels/frame].

The screen size, the visual brightness, and the input signal resolution do not directly affect the line scroll value measured by the line scroll method and are not restricted to the above conditions. The viewing distance in a range of 0.5H to 5H does not affect the measurement of the line scroll value.

The MPRT (Moving Picture Response Time) method has been proposed recently as another image quality evaluation method of general moving images. The line scroll method is correlated to the MPRT method. It is ensured that the evaluation results by the line scroll method are substantially equivalent to the evaluation results by the MPRT method.

(2) Moving Image Quality Characteristic

Figure 23:
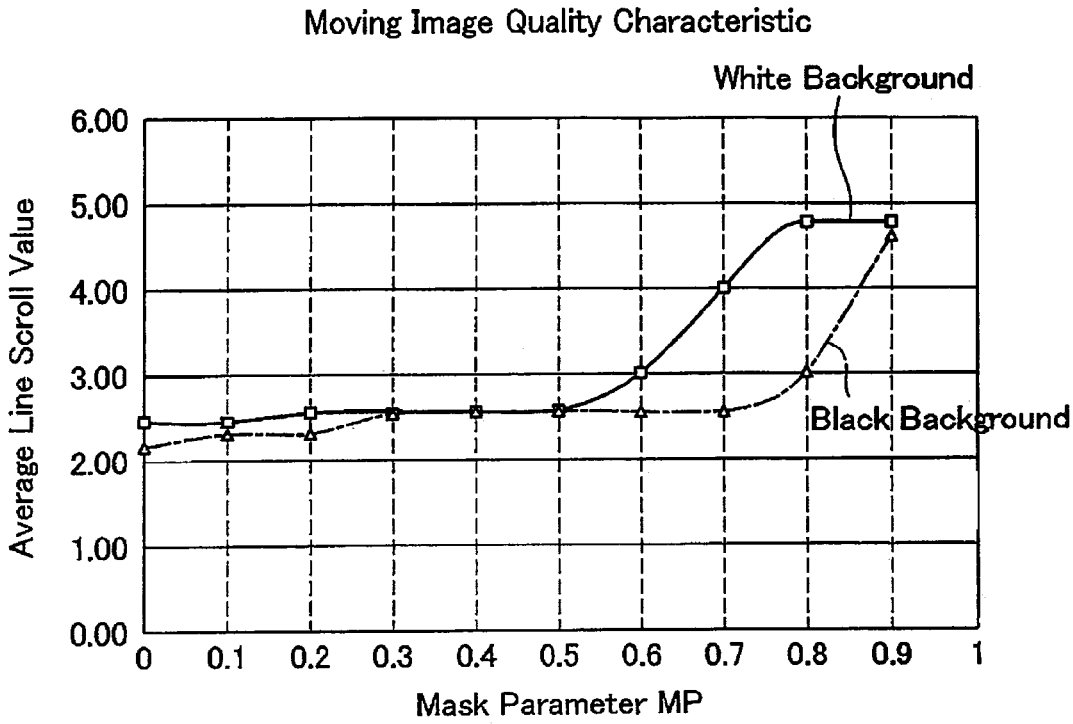
FIG. 23 shows moving image quality characteristic expressed as a variation in average line scroll value against mask parameter MP.

FIG. 23 shows the moving image quality characteristic expressed as a variation in average line scroll value against the mask parameter MP.

The moving image quality characteristic is given as a variation in moving image quality evaluated by the line scroll method against the mask parameter MP in a value range of 0 to 1. A solid line curve shows the moving image quality characteristic in a displayed image of black vertical lines against white background. A one-dot chain line curve shows the moving image quality characteristic in a displayed image of white vertical lines against black background. The difference in moving image quality characteristic is ascribed to the on/off characteristics of liquid crystal. The system of this embodiment uses a normally white liquid crystal panel as the liquid crystal panel 100. The moving image quality characteristic of FIG. 23 is obtained for this normally white liquid crystal panel. For a normally black liquid crystal panel, the solid line curve and the one-dot chain line curve are expected to inversely show the moving image quality characteristic in the displayed image of black background and the moving image quality characteristic in the displayed image of white background.

As clearly understood from FIG. 23, when the mask parameter MP is in a value range of 1 to 0.5, the average line scroll value is reduced with a decrease of the mask parameter MP to have the enhanced effect of mask data on reduction of blur of the moving image. When the mask parameter MP is in a value range of 0.5 to 0, on the other hand, the average line scroll value is not significantly varied with a variation of the mask parameter MP to keep the effect of mask data on reduction of blur of the moving image at a substantially constant level.

D3.2. Contrast Characteristic

Figure 24:
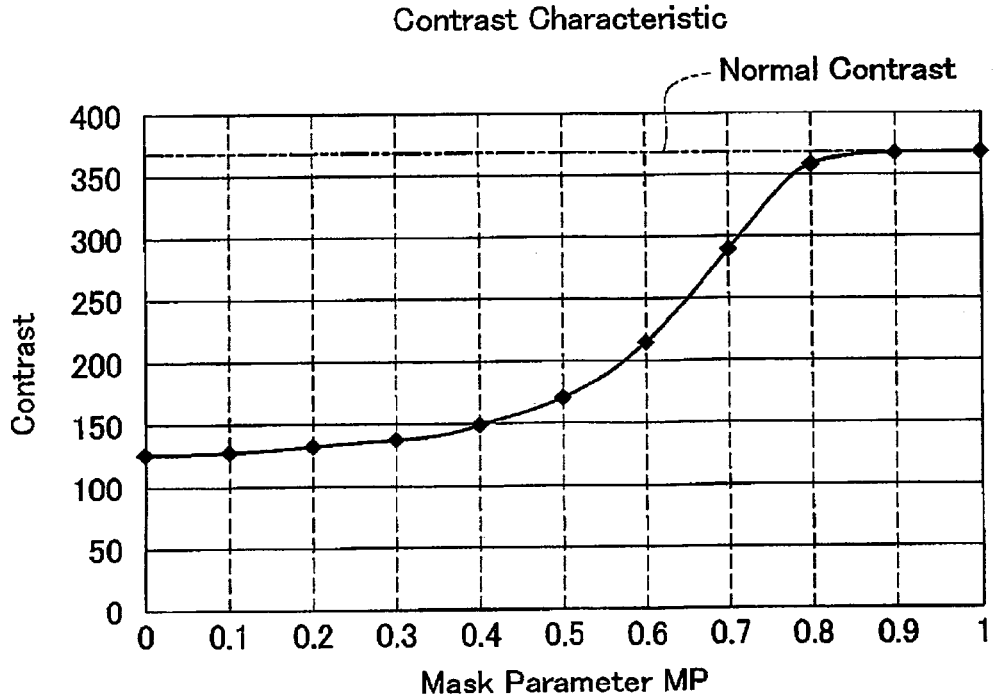
FIG. 24 shows contrast characteristic expressed as a variation in contrast against the mask parameter MP.

FIG. 24 shows the contrast characteristic expressed as a variation in contrast against the mask parameter MP.

The contrast characteristic is given as a variation in contrast level against the mask parameter MP in a value range of 0 to 1.

As clearly understood from FIG. 24, when the mask parameter MP is in a value range of 0 to 0.5, the contrast level is lowered to about ⅓ the normal contrast level at the mask parameter MP=1 (the contrast level of approximately 370 to 1 in FIG. 24). The contrast level is not significantly varied with a variation of the mask parameter MP in this value range. When the mask parameter MP is in a value range of 0.5 to 0.8, the contrast level rises with an increase of the mask parameter MP to ensure the enhanced effect of the contrast. When the mask parameter MP is in a value range of 0.8 to 1, the contrast level is substantially equal to the normal contrast level at the mask parameter MP=1.

D3.3. Mask Parameter Characteristic

According to the moving image quality characteristic shown in FIG. 23, the minimum value of the mask parameter MP varied against the amount of motion Vm is to be set in the value range of 0.5 to 1.

According to the contrast characteristic shown in FIG. 24, with a decrease of the mask parameter MP, the contrast level is gradually lowered at the minimum to about ⅓ the normal contrast level at the mask parameter MP=1 (the contrast level of approximately 370 to 1 in FIG. 24).

A normal image display mode allows a decrease in contrast level to approximately 70% of the normal contrast level. The mask parameter MP is thus set in a range corresponding to the contrast level of 70%, that is, in a range of not less than 0.65 in the illustrated example of FIG. 24. A moving image display preference mode allows a decrease in contrast level to approximately 50%. The mask parameter MP is thus set in a range corresponding to the contrast level of 50%, that is, in a range of not less than 0.5 in the illustrated example of FIG. 24.

The minimum value of the mask parameter MP varied against the amount of motion Vm is thus to be set in the value range of 0.5 to 1 according to the allowable decrease of the contrast level.

The setting conditions of the mask parameter are specified according to the measurement results of the moving image quality characteristic and the contrast characteristic. The mask parameter is then set under the specified setting conditions.

Figure 25:
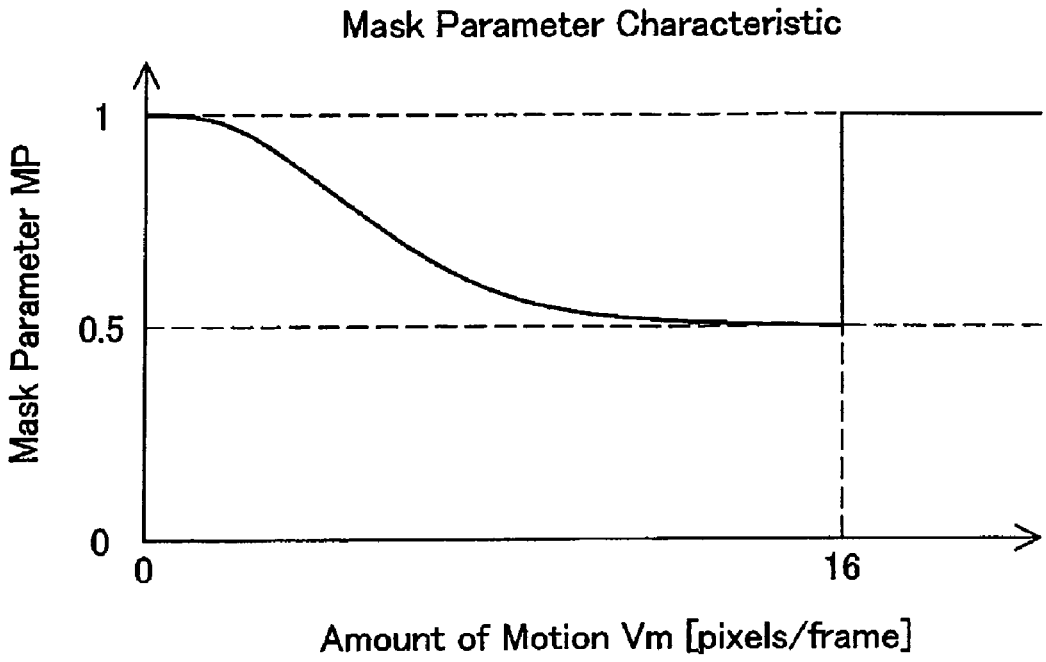
FIG. 25 shows mask parameter characteristic given by table data stored in a mask parameter reference table.

FIG. 25 shows the mask parameter characteristic given by the table data stored in the mask parameter reference table 536. The mask parameter characteristic is given as the variation of the mask parameter MP against the amount of motion Vm as shown in FIG. 25. The amount of motion Vm represents a moving speed [pixels/frame] expressed by the number of pixels moving in one frame.

The mask parameter characteristic of FIG. 25 depends upon the moving image quality characteristic of FIG. 23 and the contrast characteristic of FIG. 24. The mask parameter MP is set to gradually decrease in a value range of 1 to 0.5 with an increase in amount of motion Vm of the moving image corresponding to the scroll amount measured by the line scroll method.

The mask parameter MP close to 1 gives a significant increase of the average line scroll value as shown by the moving image quality characteristic of FIG. 23 and lowers the effect of reducing blur of the moving image. The moving image with the mask parameter MP close to 1, however, has only the small amount of motion Vm. Even the lowered effect of blur reduction is thus sufficient.

According to the explanation of the line scroll method, the amount of motion Vm of greater than 16 [pixels/frame] exceeds the limit viewing angle rate θmax (=30 [degrees/second]), that is, the perception limit of a moving image. When the amount of motion Vm is greater than 16 [pixels/frame], the displayed image is treated not as a moving image but as a still image in an image transition to a different scene. The mask parameter MP is accordingly set to 1.

D4. Effects of Embodiment

As described above, the image expressed by the mask data is displayed momentarily in each pixel, prior to display of a next image expressed by newly generated read image data. This technique desirably decreases the potential effects of a previously displayed image on the newly displayed image, thus effectively reducing blur of a moving image to the equivalent level to that attained by the prior art technique.

The prior art technique temporarily displays a black level image in each pixel, prior to display of a next image expressed by newly generated read image data, with a view to eliminating the potential effects of a previously displayed image from the newly displayed image and reducing blur of a moving image. This reduces the actual luminance of a displayed image to almost half the theoretical luminance of each frame image and significantly lowers the contrast of the displayed image. The mask data used in this embodiment, on the other hand, has the tone level attenuated from the expected tone level of object image data to be displayed, according to the amount of motion (degree of motion) of the image. The attenuated tone level of the mask data is higher than the black level to prevent reduction of the actual luminance of the displayed image, but still ensures the equivalent effect on reduction of blur of the moving image. Namely the technique of this embodiment has the sufficient effect on reduction of blur of a moving image, while preventing a significant decrease of the contrast.

E. Modification

The embodiments and their modified examples discussed above are to be considered in all aspects as illustrative and not restrictive. There may be many other modifications, changes, and alterations without departing from the scope or spirit of the main characteristics of the present invention. Some examples of possible modification are given below.

E1. Modified Example A

Figure 26:
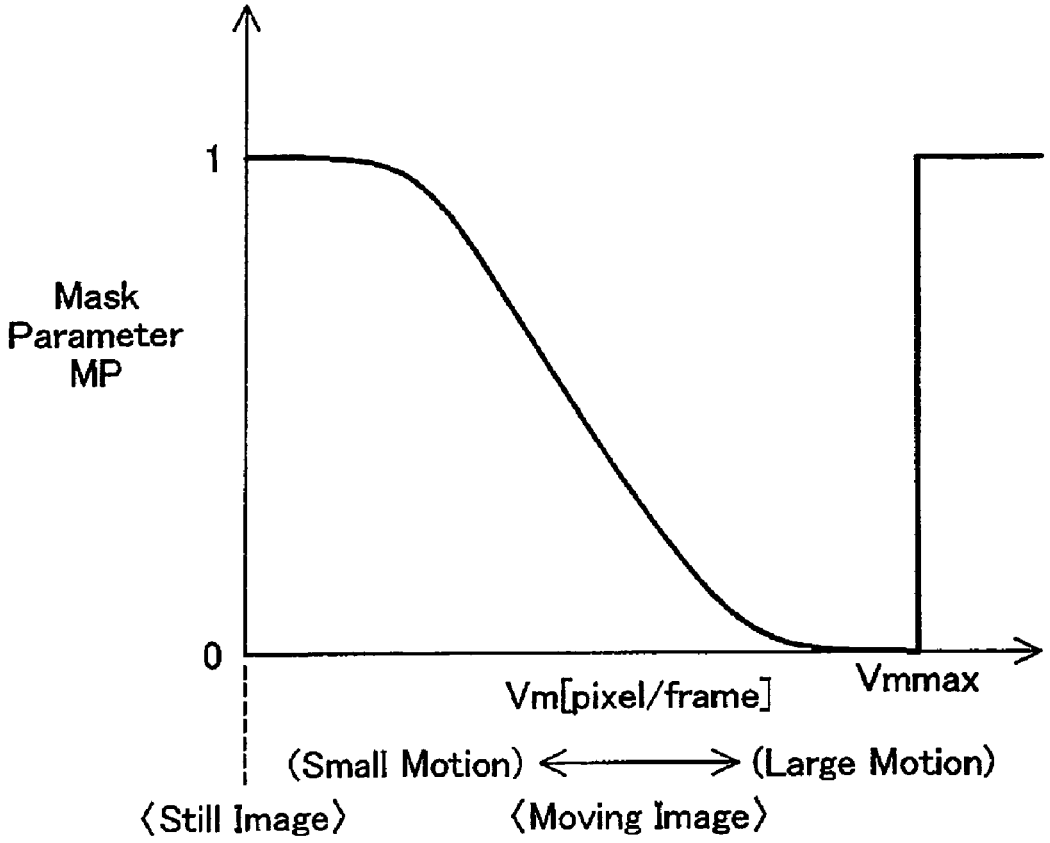
FIG. 26 shows another example of table data representing a variation in mask parameter MP against amount of motion Vm.

FIG. 26 shows another example of table data representing a variation in mask parameter MP against the amount of motion Vm.

In the image display system of the first embodiment, the table data is designed to vary the mask parameter MP in the value range of 0 to 1 against the amount of motion Vm and to give the greater value of the mask parameter MP corresponding to the smaller amount of motion Vm and the smaller value of the mask parameter MP corresponding to the greater amount of motion Vm, as shown in FIG. 4. The mask parameter MP is set equal to 1 against the amount of motion Vm of not greater than a preset first reference value, while being set equal to 0 against the amount of motion Vm of not smaller than a preset second reference value.

The viewer's eye-tracking for perception of a moving image is defined by a viewing angle rate [degrees/second]. As is known in the art, the maximum possible speed θmax of eye-tracking in a short time period (limit viewing angle rate θmax) is 30 [degrees/second]. This limit viewing angle rate θmax is assumed to show the perception limit of a moving image.

When the amount of motion Vm reaches or exceeds a specific level Vmmax corresponding to the limit viewing angle rate, the displayed image is treated not as a moving image but as a still image in an image transition to a different scene. The mask parameter MP is accordingly set to 1 as shown in FIG. 26.

The limit viewing angle rate θmax is converted into the amount of motion Vmmax [pixels/frame] as:

$$fv \cdot Vm\max \cdot (W/Xn) = 2 \cdot 3H \cdot \tan(\theta\max/2)$$

$$Vm\max = 2 \cdot (1/fv) \cdot (3H/W) \cdot Xn \cdot \tan(\theta\max/2) \quad (4)$$

where fv, H, W, and Xn respectively denote the frame frequency, the vertical length of a displayed image, the lateral length of the displayed image, and the resolution in the lateral direction. 3H represents the viewing distance of the image defined as 'HDTV standard viewing condition' by the Institute of Image Information and Television Engineers.

E2. Modified Example B

In the first embodiment and its first through fifth modified examples discussed above, the frame image data sequentially written into the frame memory are read out at the 2-fold or higher rate, and each frame image data is converted into the read image data of multiple fields. One modified procedure may read out the frame image data sequentially written into the frame memory at the identical rate with the writing rate. Among the sequentially read-out frame image data, odd-numbered frame image data and even-numbered frame image data are respectively set to the read image data of the first field and the read image data of the second field in the first embodiment and its first through fifth modified examples. Insertion of corresponding mask data into the read image data generates driving image data signals.

E3. Modified Example C

All the embodiments discussed above regard the projector with the liquid crystal panel. The technique of the invention is, however, not restricted to the projectors but is also applicable to direct-view display devices, as well as to diversity of storage display devices other than the liquid crystal panels, for example PDPs (plasma display panels) and ELDs (electro luminescence displays). In application of the invention to a light-emitting display device, such as PDP, with a view to regulating the luminance according to the amount of motion of an image like the second embodiment, the image display system includes a light emission regulation unit to adjust the emission luminance of the display device.

E4. Modified Example D

In the driving image data generation module 50 of the first embodiment and the driving image data generation module 50G of the third embodiment, the first latch 520 sequentially latches the read image data signal RVDS read from the frame memory 20. One modified structure may include an additional frame memory placed in the upstream of the first latch 520. The read image data signal RVDS is written into the additional frame memory, and the first latch 520 sequentially latches a read image data signal output from the additional frame memory. The image data signals input into the motion amount detection module 60 are the image data signal written into the additional frame memory and the image data signal read from the additional frame memory.

E5. Modified Example E

In the respective embodiments discussed above, the mask data is generated for each pixel of the read image data. One possible modification may generate mask data only for pixels that actually require replacement with the generated mask data. Any technique may be adopted to generate mask data for pixels that require data replacement and to actually replace the read image data of the pixels with the generated mask data.

E6. Modified Example F

In the image display system of any of the above embodiments, the memory write control module, the memory read control module, the driving image data generation module, and the motion amount detection module are actualized by the hardware configuration. At least part of these functional blocks may alternatively be actualized by the software configuration to be executed by the CPU according to a computer program.

E7. Modified Example G

The image display system of the fourth embodiment generates the driving image data to arrange the read image data and the mask data alternately in every other pixel in both the horizontal direction and the vertical direction. The driving image data may be generated to arrange the read image data and the mask data alternately on every other horizontal line or to arrange the read image data and the mask data alternately on every other vertical line.

E8. Modified Example H

In the image display system of the fourth embodiment, the frame image data sequentially written into the frame memory are read out at the 2-fold rate, and each frame image data is converted into the read image data of the first field and the read image data of the second field. One modified procedure may sequentially read out the frame image data at a higher rate than the 2-fold rate, convert the sequentially read frame image data alternately into the read image data of the first field and the read image data of the second field, and generate the driving image data signal with insertion of corresponding mask data into the read image data. Another modified procedure may read out the frame image data sequentially written into the frame memory at the identical rate with the writing rate. Among the sequentially read-out frame image data, odd-numbered frame image data and even-numbered frame image data are respectively set to the read image data of the first field and the read image data of the second field in the fourth embodiment. Insertion of corresponding mask data into the read image data generates driving image data signals.

All changes within the meaning and range of equivalency of the claims are intended to be embraced therein. The scope and spirit of the present invention are indicated by the appended claims, rather than by the foregoing description.

Finally, the present application claims the priority based on Japanese Patent Application No. 2004-317617 filed on Nov. 1, 2004, Japanese Patent Application No. 2005-236529 filed on Aug. 17, 2005, and Japanese Patent Application No. 2005-236532 filed on Aug. 17, 2005, which are herein incorporated by reference.

What is claimed is:

1. An image data processing device that generates driving image data used to drive an image display device with an LCD, the image data processing device comprising:

an image memory that sequentially stores input image data of multiple frames;

a write control module that controls a writing operation into the image memory;

a read control module that controls a reading operation from the image memory; and a driving image data generation module that generates the driving image data from read image data sequentially read from the image memory by replacing at least part of the read image data with regard to selected pixels with mask data, the driving image data being data for driving the LCD of the image display devices, the driving image data generation module generates first driving image data and second driving image data by arranging the read image data and the mask data alternately on every 'm' horizontal lines in an image displayed by the image display device, where 'm' is an integer of not less than 1, and the first driving image data and the second driving image data having different sequences of the read image data and the mask data, wherein:

the mask data is set corresponding to a pixel value of the read image data in each of the selected pixels to be replaced with the mask data, the mask data is generated by a preset operation of the read image data with regard to the selected pixels to be replaced with the mask data, based on a specific parameter set according to an amount of motion of a whole image expressed by the read image data, and the specific parameter is set to vary a ratio of the mask data to the pixel value of the corresponding read image data in a value range of 0 to 1 and to give a smaller ratio against a greater amount of motion and a greater ratio against a smaller amount of motion.

2. The image data processing device in accordance with claim 1, wherein the specific parameter is set to give the ratio equal to 1 when the amount of motion is greater than a predetermined reference level.

3. The image data processing device in accordance with claim 2, wherein the predetermined reference level corresponds to a limit viewing angle rate representing a maximum possible speed of eye tracking.

4. The image data processing device in accordance with claim 1, wherein 'm' is equal to 1.

5. The image data processing device in accordance with claim 1, wherein the driving image data generation module alternately generates the first driving image data and the second driving image data in a unit of image displayed by the image display device.

6. The image data processing device in accordance with claim 1, wherein:

the driving image data generation module generates the first driving image data and the second driving image data by arranging the read image data and the mask data alternately on every 'n' vertical lines in an image displayed by the image display device, where 'n' is an integer of not less than 1, and the first driving image data and the second driving image data having different sequences of the read image data and the mask data.

7. The image data processing device in accordance with claim 6, wherein 'n' is equal to 1.

8. The image data processing device in accordance with claim 6, wherein the driving image data generation module alternately generates the first driving image data and the second driving image data in a unit of image displayed by the image display device.

9. The image data processing device in accordance with claim 1, wherein:

the driving image data generation module generates the first driving image data and the second driving image data by arranging the read image data and the mask data alternately in every block defined by 'p' pixels in a horizontal direction and 'q' pixels in a vertical direction in an image displayed by the image display device, where 'p' and 'q' are integers of not less than 1, in both the horizontal direction and the vertical direction, and the first driving image data and the second driving image data having different sequences of the read image data and the mask data.

10. The image data processing device in accordance with claim 9, wherein 'p' and 'q' are both equal to 1.

11. The image data processing device in accordance with claim 9, wherein the driving image data generation module alternately generates the first driving image data and the second driving image data in a unit of image displayed by the image display device.

12. The image data processing device in accordance with claim 1, wherein:

the driving image data generation module generates first to (r/s)-th driving image data by replacing the read image data with the mask data at a rate of 's' consecutive pixels to 'r' pixels aligned on each horizontal line in an image displayed by the image display device, where 'r' is an integer of not less than 3 and 's' is an aliquot of 'r', positions of the mask data in the 's' pixels among the aligned 'r' pixels being shifted at a cycle of 't' horizontal lines, where 't' is an integer of not less than 1, and the first through the (r/s)-th driving image data having different positions of the mask data.

13. The image data processing device in accordance with claim 12, wherein the driving image data generation module sequentially generates the first through the (r/s)-th driving image data in a unit of image displayed by the image display device.

14. The image data processing device in accordance with claim 1, wherein the driving image data generation module generates first driving image data including only the read image data arranged in a whole image displayed by the image display device and second driving image data including only the mask data arranged in a whole image displayed by the image display device.

15. The image data processing device in accordance with claim 1, wherein the read image data is read from the image memory at a plural-fold rate of a frame rate for storage of the input image data of the multiple frames.

16. The image data processing device in accordance with claim 1, wherein the driving image data generation module generates dimmer data according to the amount of motion, where the dimmer data is used by a dimmer unit to regulate an amount of light emission of the image display device.

17. The image data processing device of claim 1, further comprising a mask parameter reference table that stores a value of a mask parameter that corresponds to the amount of motion.

18. The image data processing device of claim 1, further comprising a dimmer parameter reference table that stores a value of a dimmer parameter that corresponds to the amount of motion.

19. The image data processing device of claim 18, wherein the dimmer parameter is set to vary a ratio of the dimmer data to the pixel value of the corresponding read image data in a value range of 0 to 1 and to give a greater ratio against a greater amount of motion and a smaller ratio against a smaller amount of motion.

20. An image data processing device that generates driving image data used to drive an image display device with an LCD, the image data processing device comprising:

an image memory that sequentially stores input image data of multiple frames;

a motion amount detection module that detects an amount of motion of a whole image expressed by read image data sequentially read from the image memory; and a driving image data generation module that generates the driving image data by replacing at least part of the read image data with regard to selected pixels with mask data generated according to the detected amount of motion, the driving image data being data for driving the LCD of the image display device, the driving image data generation module generates first driving image data and second driving image data by arranging the read image data and the mask data alternately on every 'm' horizontal lines in an image displayed by the image display device, where 'm' is an integer of not less than 1, and the first driving image data and the second driving image data having different sequences of the read image data and the mask data.

wherein:

the mask data is generated by a preset operation of the read image data with regard to the selected pixels to be replaced with the mask data, based on a specific parameter set according to the detected amount of motion, the specific parameter is set to vary a ratio of the mask data to a pixel value of corresponding read image data in a value range of a certain level attaining a specific moving image quality characteristic to 1 and to give a smaller ratio against a greater amount of motion and a greater ratio against a smaller amount of motion.

21. The image data processing device in accordance with claim 20, wherein the specific parameter is set to vary the ratio in a range of 0.5 to 1.

22. The image data processing device in accordance with claim 20, wherein the specific parameter is set to keep the ratio in a specific range attaining a preset contrast characteristic.

23. The image data processing device in accordance with claim 22, wherein the specific parameter is set to keep the ratio in a value range of 0.8 to 1.

24. The image data processing device in accordance with claim 20, wherein the specific parameter is set to give the ratio equal to 1 when the detected amount of motion is greater than a predetermined reference level.

25. The image data processing device in accordance with claim 24, wherein the predetermined reference level corresponds to a limit viewing angle rate representing a maximum possible speed of eye tracking.

26. The image display system, comprising:

an image data processing device in accordance with claim 1; and the image display device.

27. The image display system in accordance with claim 26, the image display system further comprising:

a dimmer unit that regulates an amount of light emission of the image display device, wherein the driving image data generation module generates dimmer data according to the amount of motion, where the dimmer data is used by the dimmer unit to regulate the amount of light emission of the image display device.

28. The image display system in accordance with claim 27, wherein:

the image display device is a non light-emitting display device, and the dimmer unit includes:

a light source that emits illumination light for illuminating the image display device; and a controller that regulates an amount of light emission of the light source according to the dimmer data.

29. The image display system in accordance with claim 28, wherein:

the light source includes a main light source and an auxiliary light source, and the controller regulates an amount of light emission of the auxiliary light source.

30. The image display system, comprising:

an image data processing device in accordance with claim 20; and the image display device.

31. An image data processing method that generates driving image data used to drive an image display device with an LCD, the image data processing method comprising the steps of:

sequentially writing input image data of multiple frames into an image memory;

reading the input image data from the image memory; and generating the driving image data from read image data sequentially read from the image memory by replacing at least part of the read image data with regard to selected pixels with mask data, the driving image data being data for driving the LCD of the image display device, the driving image data generation module generates first driving image data and second driving image data by arranging the read image data and the mask data alternately on every 'm' horizontal lines in an image displayed by the image display device, where 'm' is an integer of not less than 1, and the first driving image data and the second driving image data having different sequences of the read image data and the mask data.

wherein:

the mask data is set corresponding to a pixel value of the read image data in each of the selected pixels to be replaced with the mask data, the mask data is generated by a preset operation of the read image data with regard to the selected pixels to be replaced with the mask data, based on a specific parameter set according to an amount of motion of a whole image expressed by the read image data, the specific parameter is set to vary a ratio of the mask data to the pixel value of the corresponding read image data in a value range of 0 to 1 and to give a smaller ratio against a greater amount of motion and a greater ratio against a smaller amount of motion.

32. An image data processing method that generates driving image data used to drive an image display device with an LCD, the image data processing method comprising the steps of:

sequentially writing input image data of multiple frames into an image memory;

reading the input image data from the image memory;

detecting an amount of motion of a whole image expressed by read image data sequentially read from the image memory; and generating the driving image data by replacing at least part of the read image data with regard to selected pixels with mask data generated according to the detected amount of motion, the driving image data being data for driving the LCD of the image display device, the driving image data generation module generates first driving image data and second driving image data by arranging the read image data and the mask data alternately on every 'm' horizontal lines in an image displayed by the image display device, where 'm' is an integer of not less than 1, and the first driving image data and the second driving image data having different sequences of the read image data and the mask data.

wherein:

the mask data is generated by a preset operation of the read image data with regard to the selected pixels to be replaced with the mask data, based on a specific parameter set according to the detected amount of motion, the specific parameter is set to vary a ratio of the mask data to a pixel value of corresponding read image data in a value range of a certain level attaining a specific moving image quality characteristic to 1 and to give a smaller ratio against a greater amount of motion and a greater ratio against a smaller amount of motion.

* * * * *